US012708160B1

(12) United States Patent
Harvey Girard et al.

(10) Patent No.: US 12,708,160 B1
(45) Date of Patent: Aug. 18, 2026

(54) THUMB OR FINGER PROTECTOR FOR PROTECTIVE GLOVE INCLUDING MULTIDIRECTIONAL MOVEMENT

(71) Applicant: BAUER HOCKEY LLC, Exeter, NH (US)

(72) Inventors: Marc Olivier Harvey Girard, Mirabel (CA); Alexis Majeau, Laval (CA)

(73) Assignee: BAUER HOCKEY, LLC, Exeter, NH (US)

( * ) Notice: Subject to any disclaimer, the term of this patent is extended or adjusted under 35 U.S.C. 154(b) by 0 days.

(21) Appl. No.: 19/278,548

(22) Filed: Jul. 23, 2025

(51) Int. Cl.
*A41D 13/08* (2006.01)
*A41D 19/015* (2006.01)
*A63B 71/14* (2006.01)

(52) U.S. Cl.
CPC ..... *A41D 13/087* (2013.01); *A41D 19/015* (2013.01); *A63B 71/143* (2013.01); *A63B 71/148* (2013.01); *A41D 2600/10* (2013.01)

(58) Field of Classification Search
CPC ..... A41D 19/01517; A41D 19/01523; A41D 19/015; A41D 19/01505; A41D 13/08; A63B 71/148; A63B 71/143
See application file for complete search history.

(56) References Cited

U.S. PATENT DOCUMENTS 6,058,503 A * 5/2000 Williams ..... A41D 13/08 2/24
6,543,057 B2 4/2003 Beland et al.
6,584,615 B1 * 7/2003 Wilder ..... A63B 71/148 2/161.3
6,959,453 B2 11/2005 Best
(Continued)

FOREIGN PATENT DOCUMENTS

DE 10010403 A1 * 9/2001 ..... A63B 71/141
DE 10010404 A1 * 9/2001 ..... A41D 19/01588
(Continued)

OTHER PUBLICATIONS

STX Halo Ice Hockey Glove, https://stx.com/products/halo-ice-hockey-glove?srsltid=AfmBOorMJwFYdwpcCs9IdAZahbWfHJtPqdllcLb4BfXZDMtMW1GIL5iE, accessed on Jul. 22, 2025.
(Continued)

*Primary Examiner* — Megan E Lynch
(74) *Attorney, Agent, or Firm* — BCF LLP

(57) ABSTRACT

A thumb or finger protector for a protective glove includes a top section, at least one middle section and a bottom section. The at least one middle is disposed between the top and bottom sections. The top and bottom sections engage a corresponding adjacent one of the at least one middle section via respective articulations. A central wire is connected to the top section extends through central passages of the middle and bottom sections and through the articulations to interconnect the sections. Left and right wires are connected to the top section extend through respective left and right passages of the middle and bottom sections and are sized to slide therein. The sliding guides formed by the left and right wires enable multidirectional movement of the thumb or finger while protecting the thumb or finger during use in the protective glove. A protective glove is also disclosed.

19 Claims, 21 Drawing Sheets

(56) References Cited

U.S. PATENT DOCUMENTS

| | | | | |
|---|---|---|---|---|
| 7,293,296 | B1 * | 11/2007 | Beraznik | A63B 71/148 2/21 |
| 7,313,830 | B2 | 1/2008 | Desjardins et al. | |
| 7,802,315 | B2 | 9/2010 | Contant et al. | |
| 8,813,262 | B2 | 8/2014 | Pechtold | |
| 9,802,104 | B2 | 10/2017 | Cox | |
| 10,905,181 | B2 * | 2/2021 | Rabbeth, Jr. | A61F 5/013 |
| 2002/0184696 | A1 * | 12/2002 | Hochmuth | A63B 71/148 2/160 |
| 2005/0251078 | A1 * | 11/2005 | Fleischmann | A41D 13/087 602/22 |
| 2006/0048259 | A1 * | 3/2006 | Keppler | A41D 19/01588 2/21 |
| 2007/0074332 | A1 | 4/2007 | Wilder et al. | |
| 2008/0196135 | A1 | 8/2008 | Gait | |
| 2009/0165185 | A1 * | 7/2009 | Contant | A63B 71/143 2/163 |
| 2009/0172864 | A1 * | 7/2009 | Fisher | A63B 71/148 2/163 |
| 2009/0307821 | A1 * | 12/2009 | Chang | A41D 19/01588 2/21 |
| 2011/0088139 | A1 * | 4/2011 | Travell | A63B 71/14 2/163 |
| 2011/0107498 | A1 * | 5/2011 | Chang | A41D 19/01588 2/163 |
| 2017/0173441 | A1 * | 6/2017 | Lemieux | A63B 71/14 |
| 2019/0289931 | A1 * | 9/2019 | Chen | A41D 13/015 |
| 2019/0328062 | A1 * | 10/2019 | Kamphuis | A41D 19/01588 |

FOREIGN PATENT DOCUMENTS

| | | | | |
|---|---|---|---|---|
| EP | 1265677 | B1 | 12/2002 | |
| EP | 2108411 | A1 * | 10/2009 | A63B 71/148 |
| GB | 2368775 | A * | 5/2002 | A41D 31/285 |

OTHER PUBLICATIONS

Bagneschi et al., "A Soft Hand Exoskeleton With a Novel Tendon Layout to Improve Stable Wearing in Grasping Assistance", IEEE Transactions on Haptics, vol. 16, No. 2, pp. 311-321, Apr.-Jun. 2023.

* cited by examiner

THUMB OR FINGER PROTECTOR FOR PROTECTIVE GLOVE INCLUDING MULTIDIRECTIONAL MOVEMENT

CROSS-REFERENCE

None.

TECHNICAL FIELD

The present technology relates to thumb or finger protectors for protective gloves including multidirectional movement.

BACKGROUND

In the field of athletic protective equipment, particularly sports gloves, there has been a consistent drive to integrate enhanced ergonomics with robust protection. Manufacturers have long recognized that as sports become increasingly competitive and physically demanding, there is a growing need for glove components that not only safeguard the hand but also maintain natural movement. This need is especially significant in gloves intended for contact sports, where both impact resistance and fluid mobility are important for performance. Designers and engineers have devoted significant effort to developing glove constructions that allow athletes to perform effectively while maintaining safety.

Various design approaches in sports gloves aim to provide an optimal balance between protection and mobility. In applications where secured components are necessary to counteract high-velocity impacts, the overall goal remains to permit a degree of natural flexibility while still preserving structural integrity. Sports gloves are intended to offer a fit that complements the diverse hand movements encountered in dynamic activities. Manufacturers continuously explore ways to refine these designs, aspiring to improve the overall user experience by merging robust safety features with enhanced dexterity during play.

Many current constructions incorporate mechanisms that, while effective in delivering necessary protection, do not fully address the range of movements required by athletes. Often, the engineered solutions in these gloves allow for movement primarily along a single axis, which may not accommodate the natural motions of the hand. Such configurations can inadvertently constrain an athlete's performance by limiting the multi-directional flow of movement that is essential for achieving optimal grip and control. The challenge has been to design systems that integrate protection without unduly sacrificing the versatility of natural hand movement.

More specifically, certain existing glove designs employ conventional linking methods that restrict multi-axis rotation and lateral mobility. This limitation can result in a less natural articulation of the hand. The challenge is compounded when design elements intended to enhance flexibility inadvertently create openings or vulnerabilities that compromise safety. These shortcomings highlight the need for more sophisticated approaches that can reconcile the dynamic demands of athletic activity with the stringent safety requirements associated with sports glove design.

Such challenges also exist in protective gloves in fields other than sports where protection and maneuverability are needed, such as in the field of construction work.

SUMMARY

It is an object of the present technology to ameliorate at least some of the inconveniences present in the prior art.

In some aspects, the techniques described herein relate to a thumb or finger protector for providing multidirectional thumb or finger movement in a protective glove, including: a top section; at least one middle section defining a left middle passage, a right middle passage, and a central middle passage; a bottom section defining a left bottom passage, a right bottom passage, and a central bottom passage, the at least one middle section being disposed between the top section and the bottom section, the top section engaging an adjacent one of the at least one middle section via a top articulation, the bottom section engaging an adjacent one of the at least one middle section via a bottom articulation; a central wire connected to the top section and extending through the central middle passage of the at least one middle section and through the central bottom passage of the bottom section for connecting the top section, the at least one middle section and the bottom section to each other, the central wire extending through the top articulation and the bottom articulation; a left wire connected to the top section and extending through the left middle passage of the at least one middle section and through the left bottom passage of the bottom section, the left wire being sized for sliding inside the left middle passage of the at least one middle section and through the left bottom passage of the bottom section; and a right wire connected to the top section and extending through the right middle passage of the at least one middle section and through the right bottom passage of the bottom section, the right wire being sized for sliding inside the right middle passage of the at least one middle section and through the right bottom passage of the bottom section, the left wire and the right wire functioning as sliding guides that, by enabling relative movement between the top section, the at least one middle section, and the bottom section, afford multidirectional motion of the thumb or finger while protecting the thumb or finger during use in the protective glove.

In some aspects, the techniques described herein relate to a thumb or finger protector, wherein: the top section defines a left top passage, a right top passage, and a central top passage; the central wire extending in the central top passage; the left wire extending in the left top passage; and the right wire extending in the right top passage.

In some aspects, the techniques described herein relate to a thumb or finger protector, wherein: the top left passage and the top right passage communicate with each other to form a U-shaped passage; and the left wire and the right wire are an integral wire extending through the U-shaped passage.

In some aspects, the techniques described herein relate to a thumb or finger protector, wherein the left wire, the right wire and the central wire are fixed to the top section.

In some aspects, the techniques described herein relate to a thumb or finger protector, wherein: the top articulation is defined by a top groove and a middle tongue received in the top groove; the top groove is defined by the top section; the middle tongue is defined by the one of the at least one middle section that is adjacent to the top section; the bottom articulation is defined by a bottom tongue and a middle groove receiving the bottom tongue; the bottom tongue is defined by the bottom section; and the middle groove is defined by the one of the at least one middle section that is adjacent to the bottom section.

In some aspects, the techniques described herein relate to a thumb or finger protector, wherein: the at least one middle section is a plurality of middle sections; and adjacent middle sections of the plurality of middle sections engage each other via a middle articulation.

In some aspects, the techniques described herein relate to a thumb or finger protector, wherein the middle articulation of the adjacent middle sections of the plurality of middle section is defined by a groove defined in one of the adjacent middle sections and by a tongue defined in another one of the adjacent middle sections.

In some aspects, the techniques described herein relate to a thumb or finger protector, wherein: the thumb or finger protector has a neutral position, a left flexed position, and a right flexed position; in the neutral position: left spaces are defined between left sides of adjacent ones of the top section, the at least one middle section, and the bottom section, and right spaces are defined between right sides of the adjacent ones of the top section, the at least one middle section, and the bottom section; in the left flexed position: the left spaces defined between the left sides of the adjacent ones of the top section, the at least one middle section, and the bottom section are smaller than in the neutral position, and the right spaces defined between right sides of the adjacent ones of the top section, the at least one middle section, and the bottom section are larger than in the neutral position; and in the right flexed position: the left spaces defined between the left sides of the adjacent ones of the top section, the at least one middle section, and the bottom section are larger than in the neutral position, and the right spaces defined between the right sides of the adjacent ones of the top section, the at least one middle section, and the bottom section are smaller than in the neutral position.

In some aspects, the techniques described herein relate to a thumb or finger protector, wherein: in the neutral position: the left wire extends from the bottom section, and the right wire extends from the bottom section; in the left flexed position: the left wire extends from the bottom section by a distance that is longer than in the neutral position; and the right wire extends from the bottom section by a distance that is shorter than in the neutral position; and in the right flexed position: the left wire extends from the bottom section by a distance that is shorter than in the neutral position; and the right wire extends from the bottom section by a distance that is longer than in the neutral position.

In some aspects, the techniques described herein relate to a thumb or finger protector, further including: a central crimp connected to an end of a portion of the central wire extending from the bottom section; a left crimp connected to an end of a portion of the left wire extending from the bottom section; and a right crimp connected to an end of a portion of the right wire extending from the bottom section.

In some aspects, the techniques described herein relate to a thumb or finger protector, wherein the left crimp and the right crimp selectively abut a free end of the bottom section.

In some aspects, the techniques described herein relate to a thumb or finger protector, wherein: each of the at least one middle section has a middle protrusion overlapping an adjacent one of: the top section, or another one of the at least one middle section, the middle protrusion limiting hyperextension.

In some aspects, the techniques described herein relate to a thumb or finger protector, wherein the top section, the at least one middle section, and the bottom section are fabricated from a rigid plastic.

In some aspects, the techniques described herein relate to a protective glove including: a hand receiving portion having four finger sheaths; a thumb member connected to the hand receiving portion; and at least one thumb or finger protector as recited above received in at least one of the four finger sheaths or the thumb member for protecting a dorsal side of a corresponding thumb or finger of a hand inserted in the protective glove.

In some aspects, the techniques described herein relate to a protective glove, wherein the at least one of the thumb and finger protector is a thumb protector received in the thumb member.

In some aspects, the techniques described herein relate to a protective glove, wherein the at least one of the thumb and finger protector is at least one finger protector received in at least one of the four finger sheaths.

In some aspects, the techniques described herein relate to a protective glove, wherein each of the four finger sheaths and the thumb member has elongated protective pads extending along a dorsal side of each of the four finger sheaths and the thumb member.

In some aspects, the techniques described herein relate to a protective glove, wherein the protective glove is a sport glove.

In some aspects, the techniques described herein relate to a protective glove, wherein the sport glove is a hockey glove.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example, "A and/or B" is to be taken as specific disclosure of each of (i) A, (ii) B and (iii) A and B, just as if each is set out individually herein.

As used herein, "at least one of A and B" is to be taken as specific disclosure of each of (i) A, (ii) B and (iii) A and B, just as if each is set out individually herein.

Embodiments of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1A:
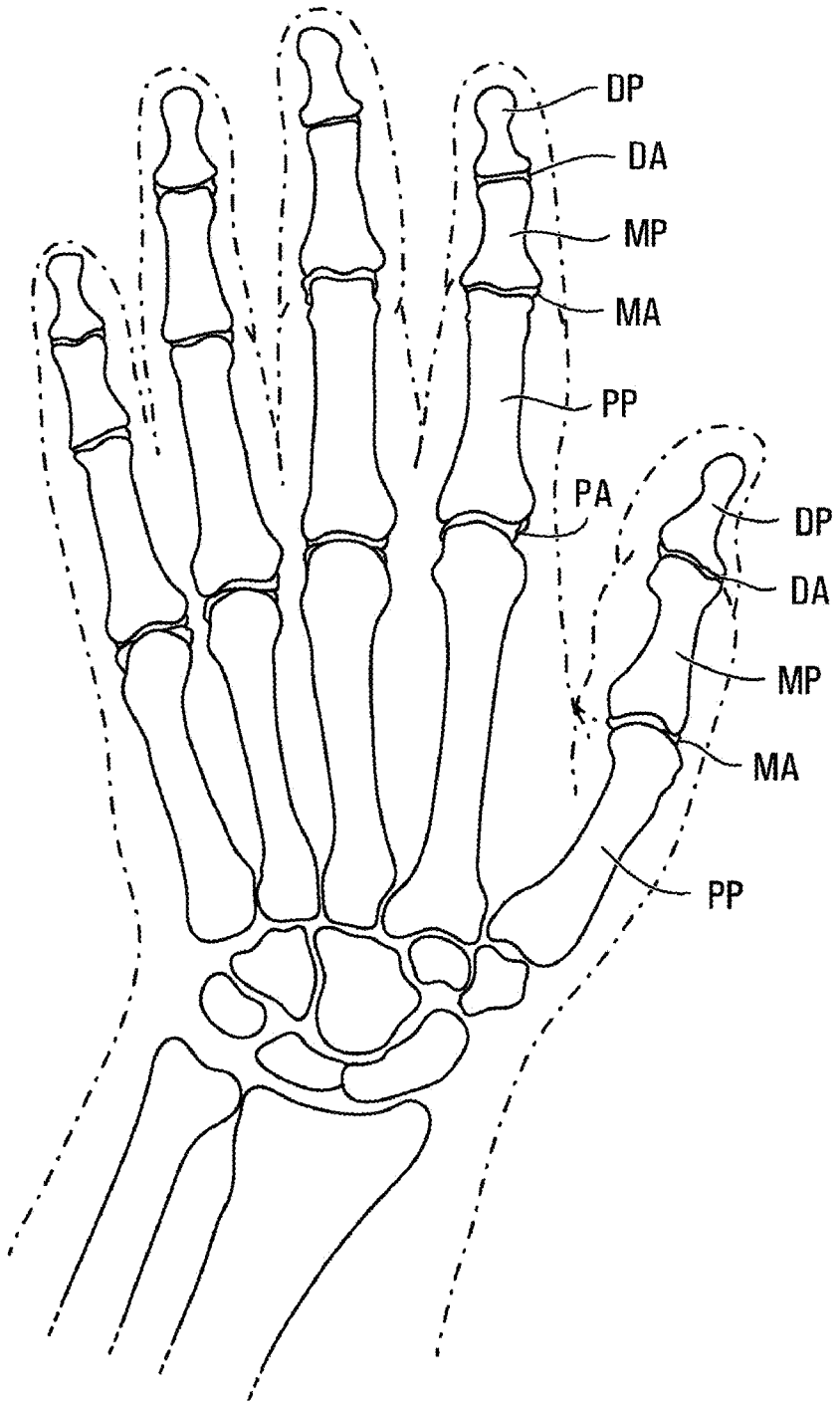
FIG. 1A is a dorsal view of a human hand with the integument of the hand shown in broken lines and the bones shown in full lines.
Figure 1B:
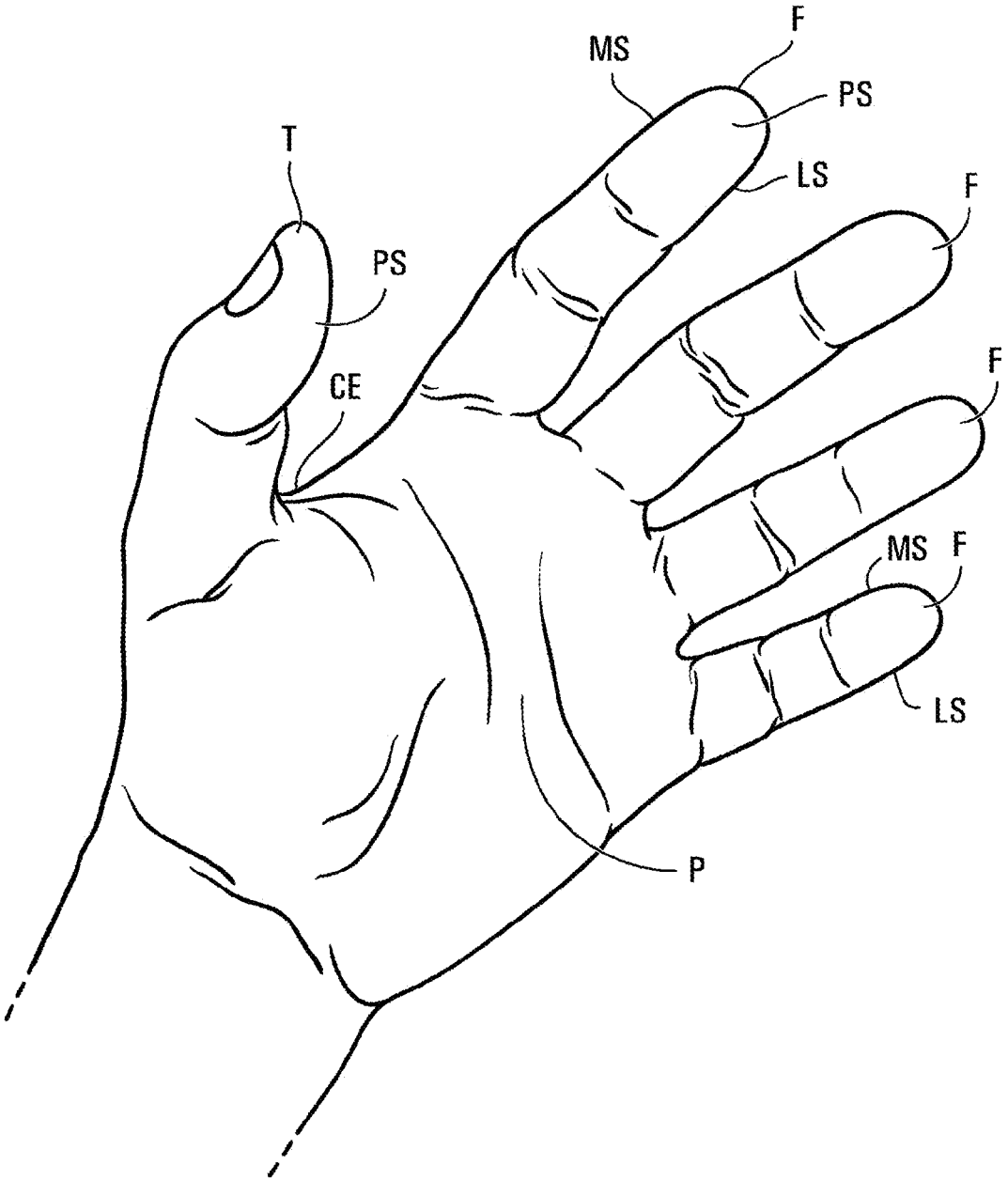
FIG. 1B is a front perspective view of a human hand.
Figure 1C:
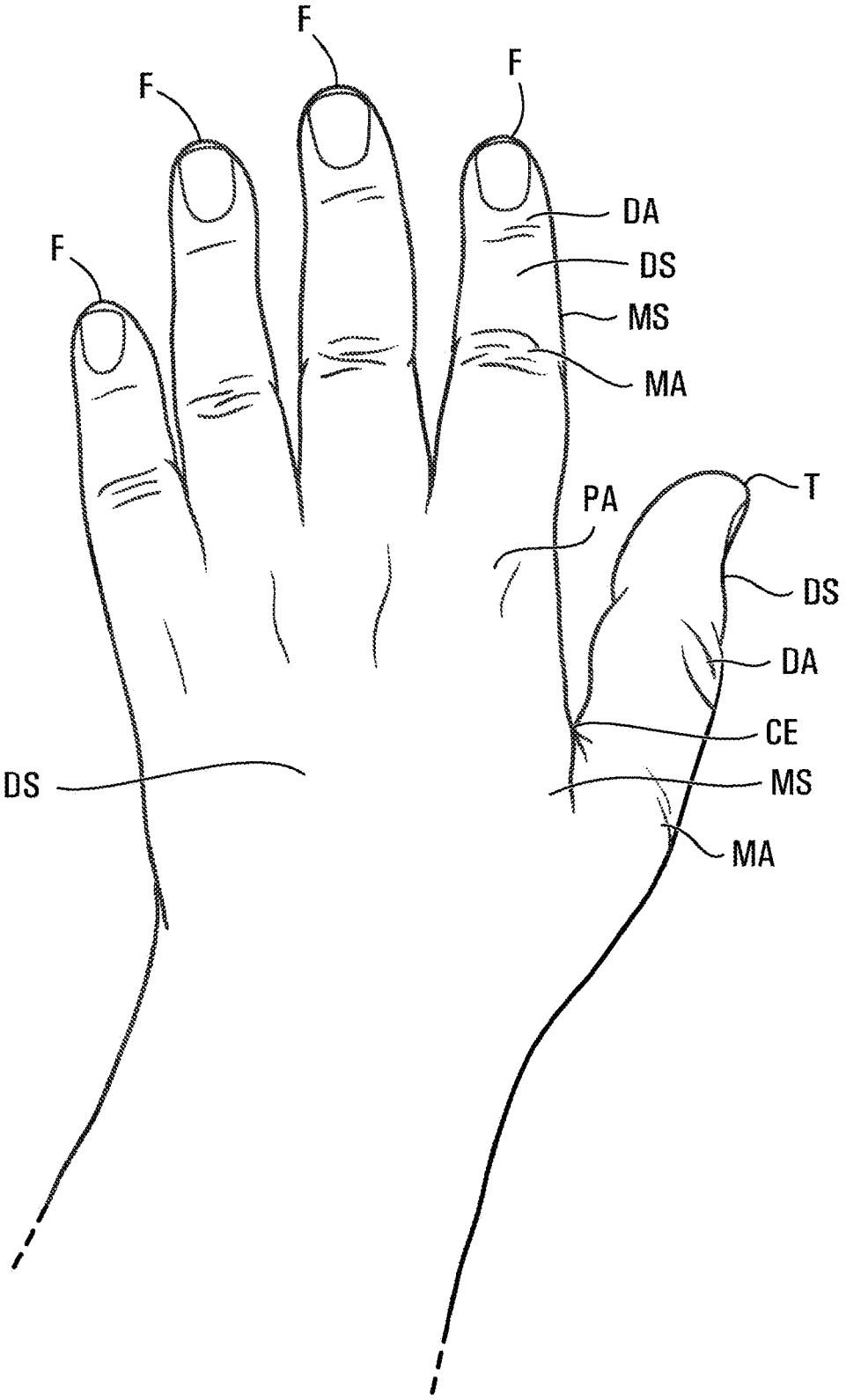
FIG. 1C is a dorsal perspective view of the human hand of FIG. 1B.
Figure 1D:
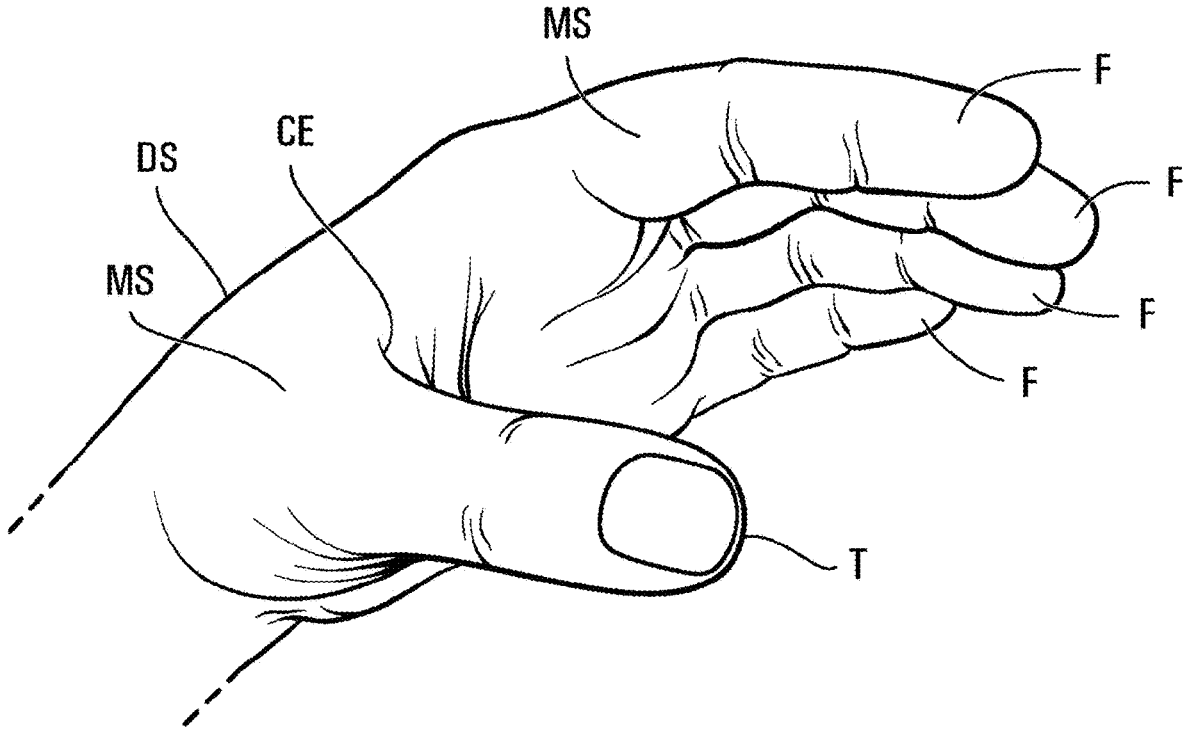
FIG. 1D is a side perspective view of the human hand of FIG. 1B.
Figure 2:
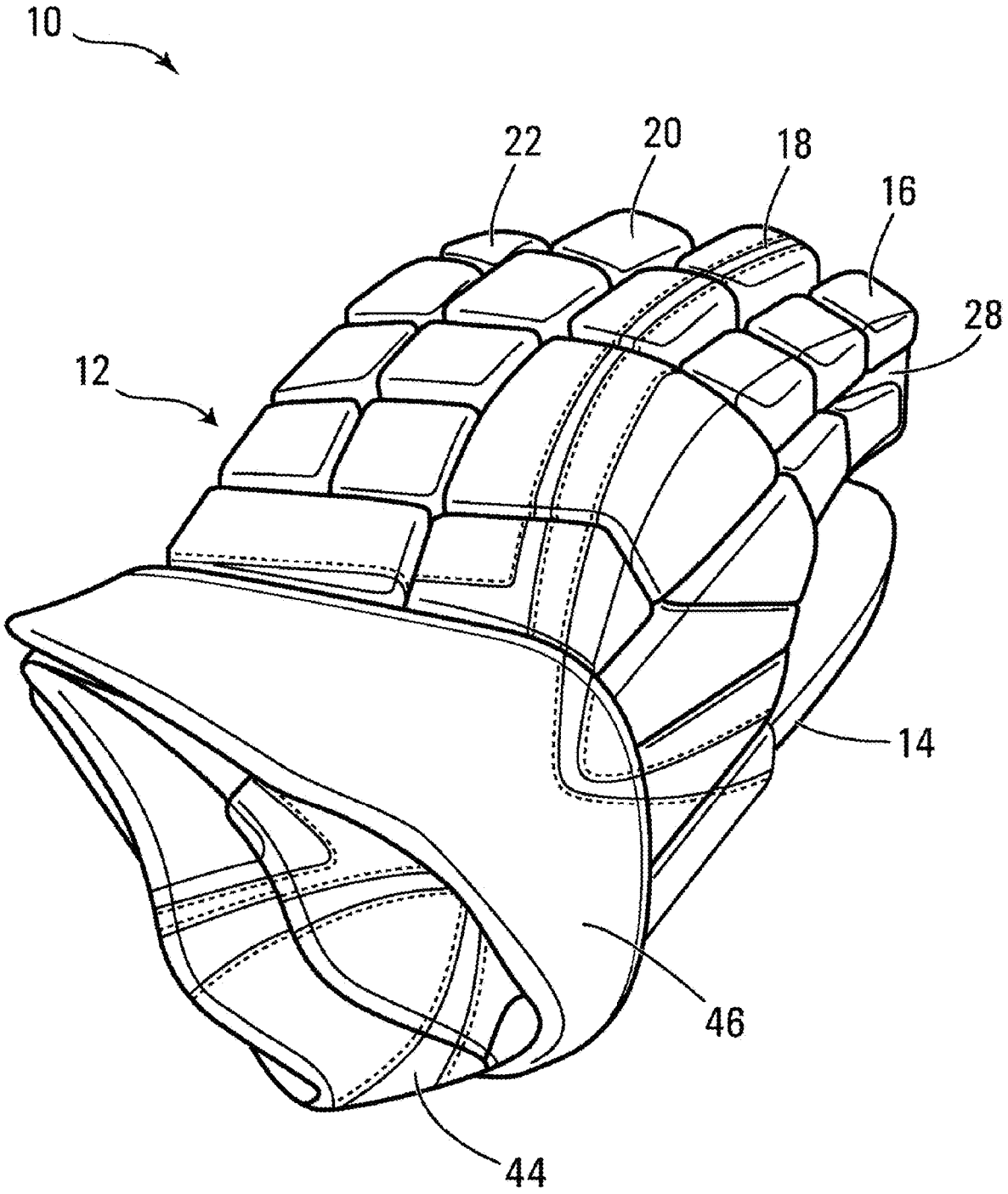
FIG. 2 is a perspective view of a hockey glove.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

The present technology will be described with reference to a hockey glove 10. However, it is contemplated that the present technology could be used in other types of protective gloves. For example, the technology could be used in gloves used in the field of construction work or in sports gloves other than hockey gloves such as lacrosse gloves.

As shown in FIGS. 1A, 1B, 1C, and 1D, a human hand has a palm P, a dorsal side DS, four fingers F (index finger, middle finger, ring finger and little finger), a thumb T and a medial side MS with a C-shaped edge CE extending between the thumb T and the index finger F. Each finger F has a palm surface PS, a dorsal surface DS, a lateral surface LS, a medial surface MS, a proximal articulation PA, a proximal phalanx PP, a middle articulation MA, a middle phalanx MP, a distal articulation DA and a distal phalanx DP. The thumb T has a palm surface PS, a dorsal surface DS, a proximal phalanx PP, a middle articulation MA, a middle phalanx MP, a distal articulation DA and a distal phalanx DP.

FIGS. 2 to 7 illustrate a hockey glove 10 for receiving the hand of the player. The hockey glove 10 has a hand receiving portion 12 for covering the palm P and dorsal side DS of the hand and extending generally to the end of the fingers F and a thumb member 14 for protecting the thumb T.

The hand receiving portion 12 has four finger sheaths 16, 18, 20, 22 for enclosing the index finger, middle finger, ring finger and little finger, a palm sheet 24 for facing the palm P and the palm surfaces PS of the respective fingers F and thumb T, and a dorsal side 26 for covering the dorsal surface DS of the hand. The palm sheet 24 is made of soft flexible material such as leather or synthetic textile material.

Each of the finger sheaths 16, 18, 20, 22 extends from an area proximal the proximal articulation PA of the finger to the end of the finger. Each of the finger sheaths 16, 18, 20, 22 has elongated protective finger pads 32 extending along the dorsal side of each finger sheath 16, 18, 20, 22 for protecting the dorsal surface DS of each finger F. A spacer (not illustrated) made of flexible material may fill the gap between the finger pads 32 of the same finger sheath and protects the player's knuckles when the finger sheath is fully bent inwardly. The finger pads 32 are made of materials conventionally found in the prior art. Such materials include polyethylene inserts and may include various composite materials designed to absorb the energy of an impact.

The hand receiving portion also has a side finger web 28 for facing the lateral surface LS and medial surface MS of each finger F, this side finger web 28 being connected to the palm sheet 24 and dorsal side 26 for defining finger gussets 30 for enclosing the fingers F. The side finger web 28 is made of an elastic synthetic material for giving added flexibility to each finger sheath while simultaneously facilitating the reduction of the moisture levels within each finger sheath.

The hockey glove 10 also has dorsal protective pads 34 for protecting the dorsal side DS of the hand and side protective pads 36 for protecting the medial side MS of the hand. The dorsal and side protective pads 34, 36 may be formed of relatively thick foam encapsulated in suitable material such as leather or nylon. The dorsal protective pads 34 are formed and grouped to substantially conform to the shape of the back of the hand and may be oriented to increase flexibility of the hand. The dorsal protective pads 34 are generally rectangular in cross-section.

It is contemplated that the hockey glove 10 could have a braiding surrounding the periphery of the thumb member 14, extending along a portion between the thumb member 14 and the index finger sheath 16 and further along the side of the index finger sheath 16.

The palm sheet 24 may be made of a four way stretch nylon fabric, leather or another natural or synthetic material selected for softness and durability and may also include holes for ventilation. The palm sheet 24 may have further tabs made of leather provided over the tips of the finger for greater abrasion resistance, improved gripping ability, and extended wear of the hockey glove 10.

The palm sheet 24 also has a reinforcing strip of material 40 extending generally diagonally across the palm sheet 24 from about the index finger to the heel of the palm on the little finger side of the glove. The reinforcing strip of material 40 is oriented to run generally parallel to the stick during the angular grasping of the stick by the player. This orientation aids grip and reduces fatigue by reducing the glove's resistance to grasping the stick at such an angle.

The palm sheet 24 also has a pad 42 covering at least partially the region of the hand where the ulnar and median nerves are located, this pad 42 being made of a suitable material for absorbing detrimental forces associated with the hockey stick-to-puck impact. It is contemplated that the pad 42 could be omitted.

The hockey glove 10 also has a flexible cuff 44 and a cuff roll 46 that at least partially covers the flexible cuff 44 for offering further protection to the back and sides of the wrist against hits from a hockey stick or the puck.

Figure 3:
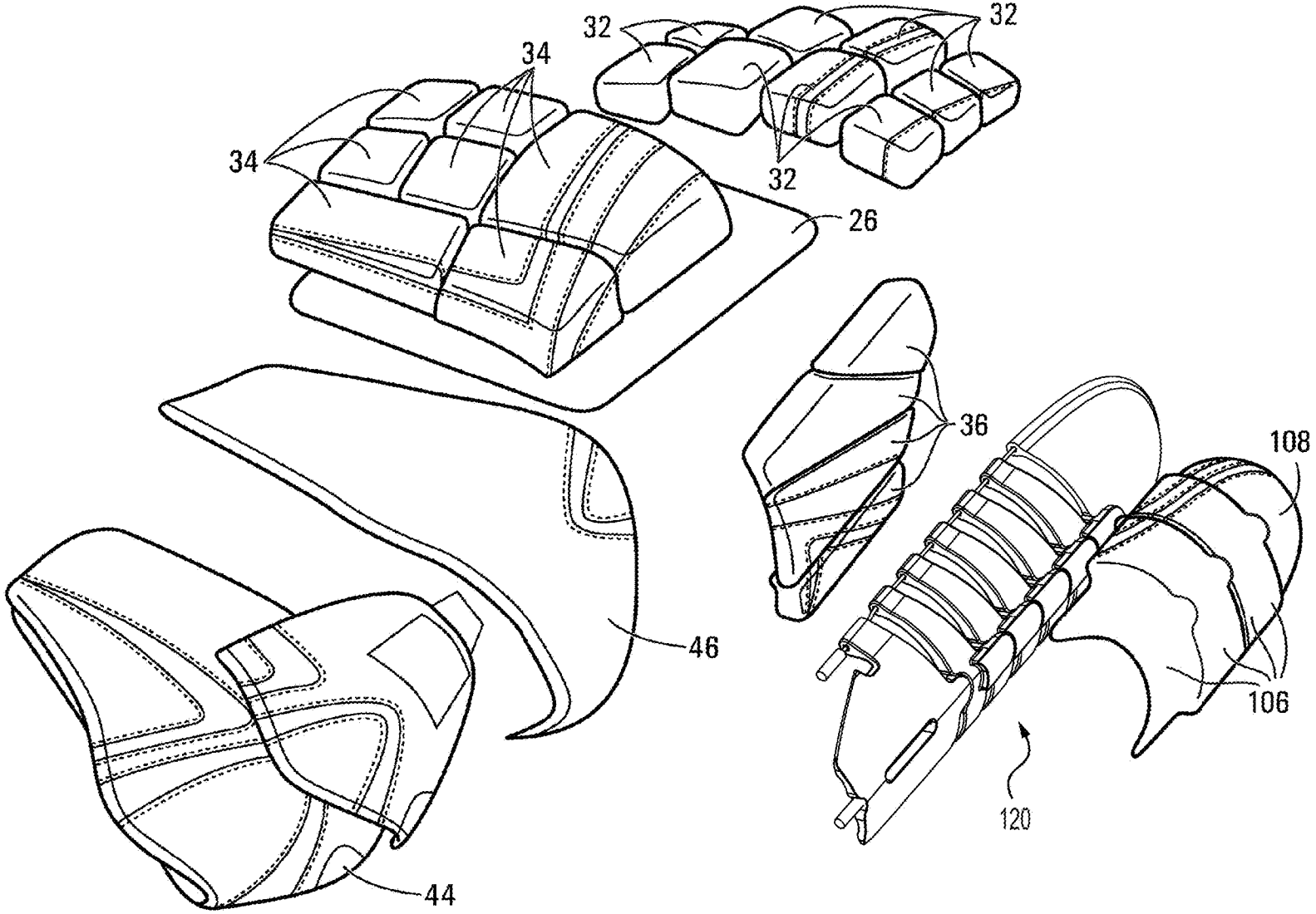
FIG. 3 is an exploded perspective view showing pads and a thumb protector of the hockey glove of FIG. 2.
Figure 4:
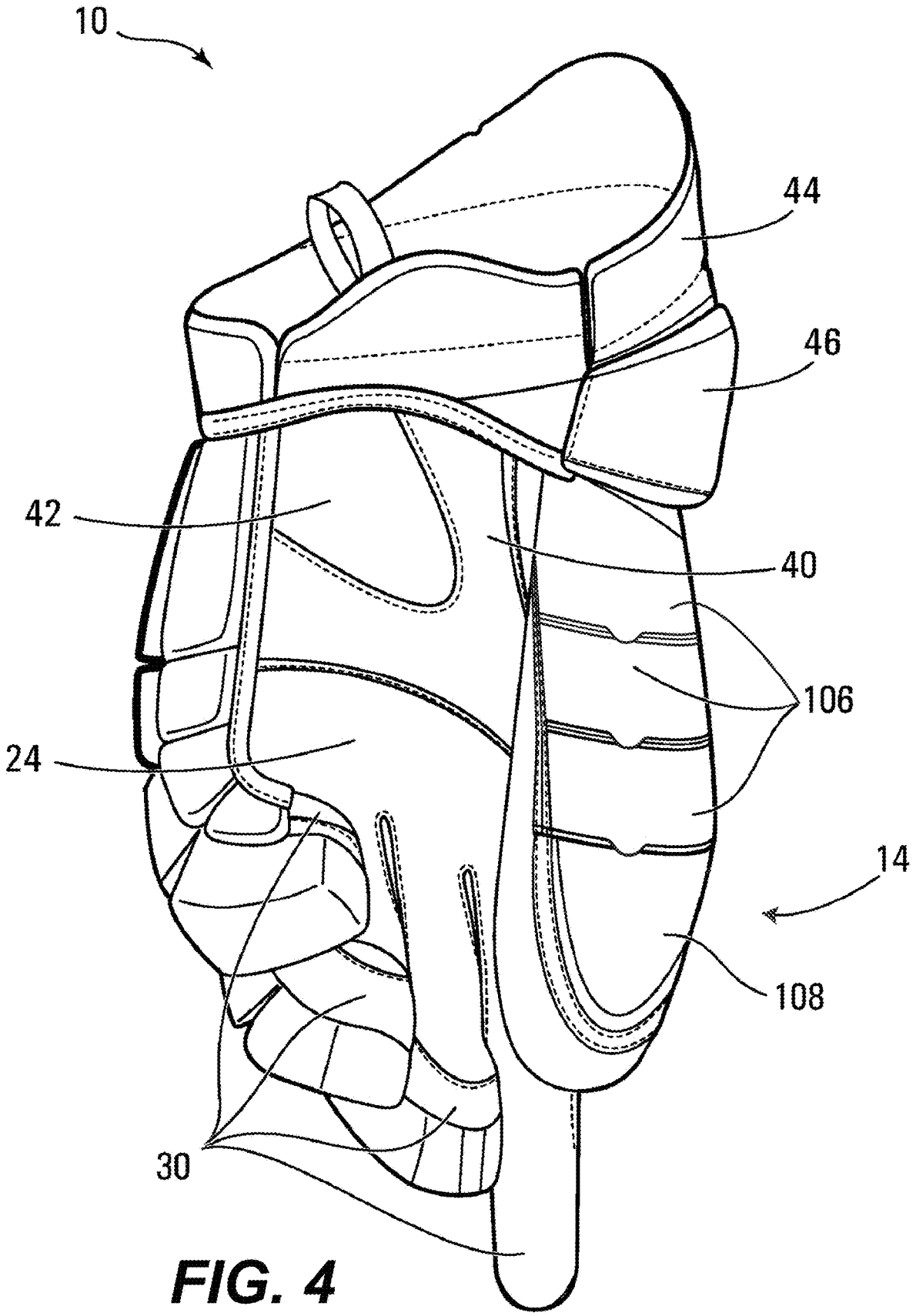
FIG. 4 is a front view of the hockey glove of FIG. 2.
Figure 5:
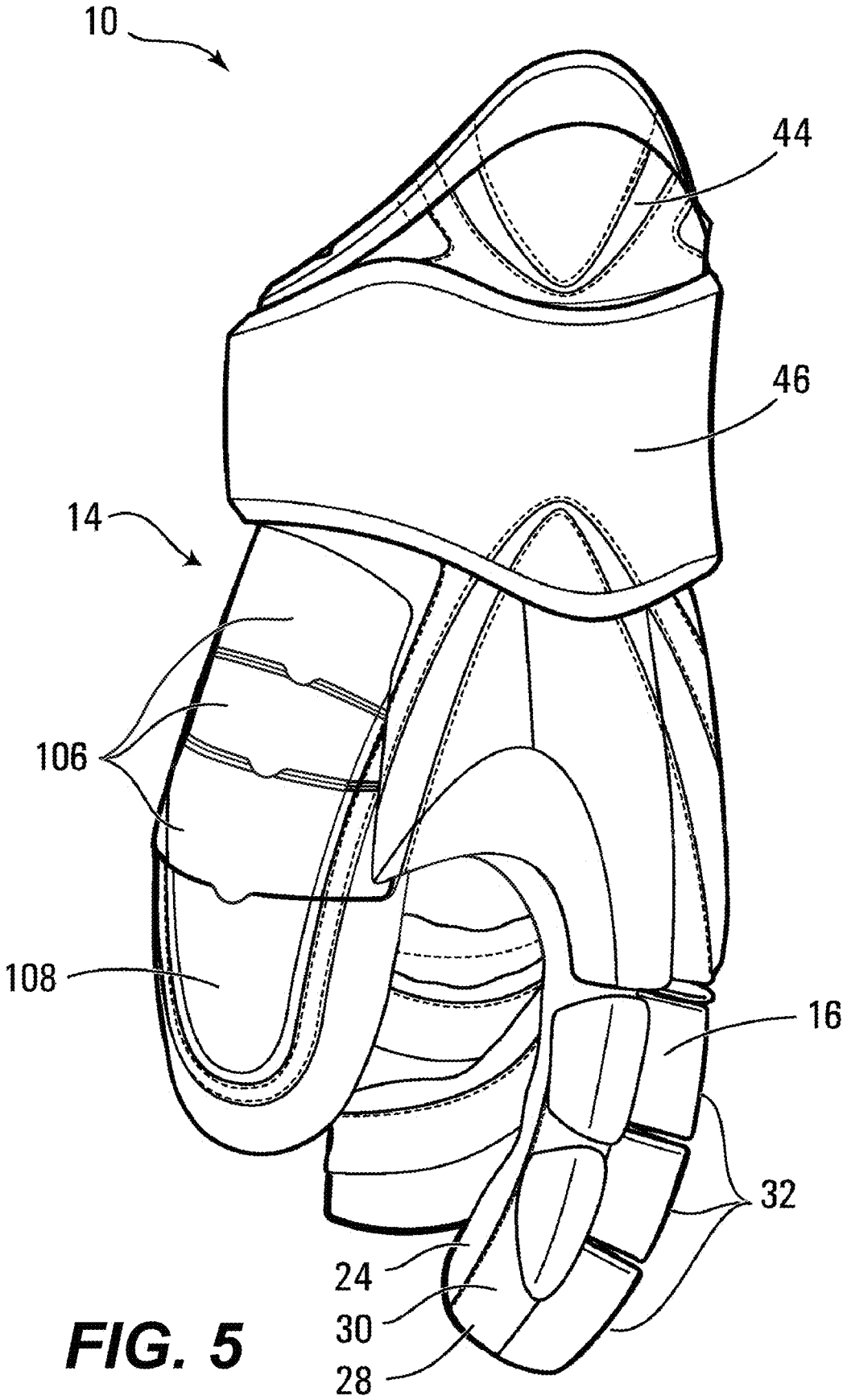
FIG. 5 is a side view of the hockey glove of FIG. 2.

As shown in FIGS. 3 and 4, the flexible cuff 44 has segmented panels affixed to the proximal end of the hand receiving portion 12 and the cuff roll 46 extends about two-thirds the distance around the flexible cuff 44. The panels are padded for protection about the wrist. The panels are covered by leather or suitable synthetic materials such as nylon. Optionally, a fairly rigid member (not shown) may be included in one or more panels for added protection of the wrist. It is contemplated that the panels could overlap slightly to further safeguard against openings around the wrist which could lead to injury. This flexible cuff 44 allows enhanced flexibility of the glove 10 for the player's hand motions, such as when hitting the hockey puck with the stick. It is understood that the flexible cuff 44 may be affixed to the hand receiving portion 12 via a suitable flexible material (e.g. via an elastic band). The cuff roll 46 may be formed of a section of foam having a thickness of about 0.25 inch to 0.5 inch, which is covered by real or synthetic leather, or other suitable material. The cuff roll 46 is attached only at its short ends.

Figure 7:
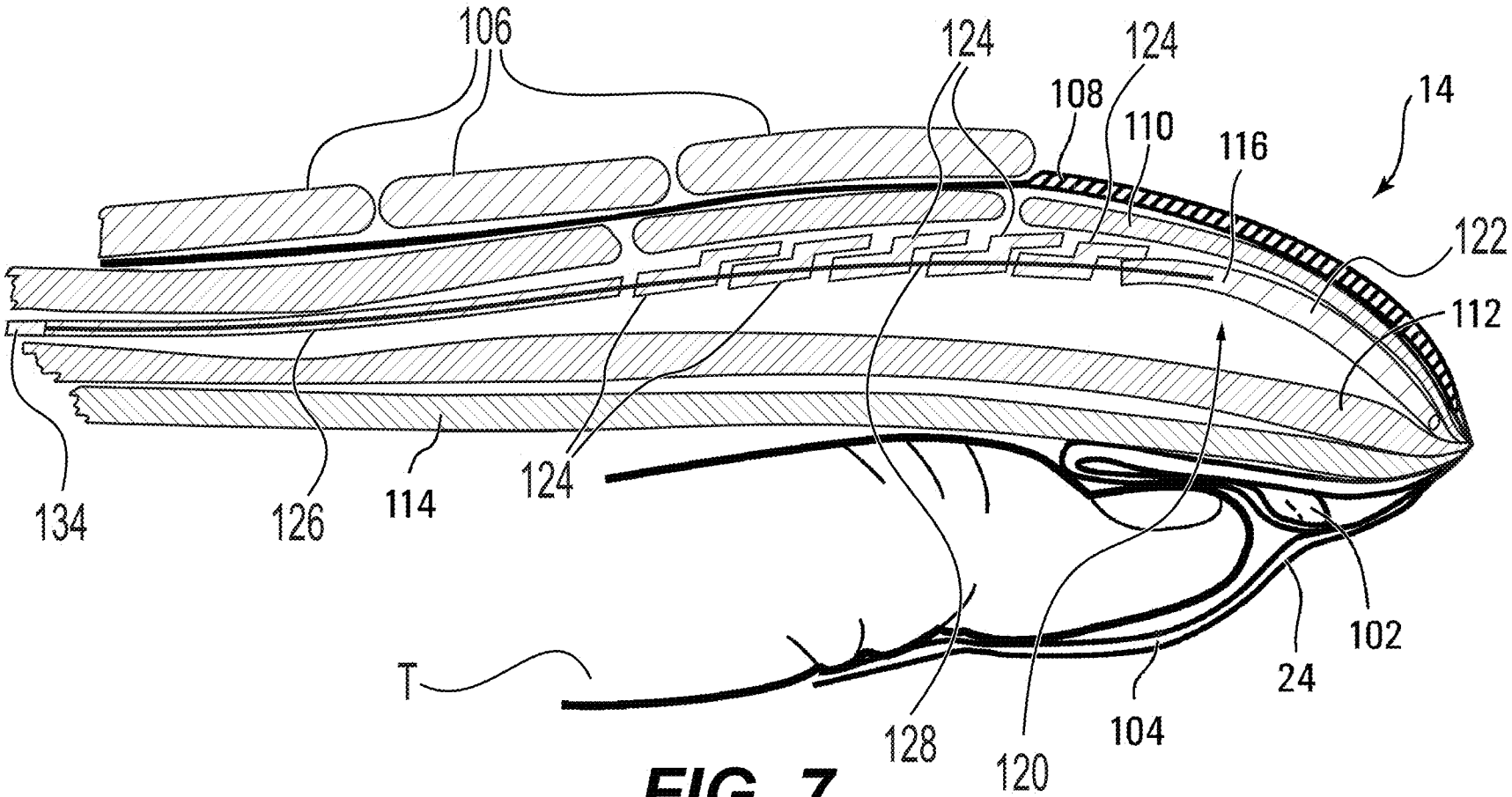
FIG. 7 is a illustrates a cut through a thumb member of the hockey glove of FIG. 2 with a thumb inserted in the thumb member.

As shown in FIG. 7, to facilitate thumb movement, the thumb member 14 has a layer 102 forming with the palm sheet 24 a thumb pocket 104 for receiving the thumb T of the player. The thumb pocket 104 allows the thumb T to move with more freedom. The thumb member 14 also has three elongated protective pads 106 and an external rigid sheet 108 for protecting the dorsal side of the thumb, top and bottom layers 110, 112 made of polyurethane foam and a bottom liner 114 for facing the dorsal side DS of the thumb. It is contemplated that the thumb member 14 could have more or less than three elongated protective pads 106. The external rigid sheet 108, top and bottom layers 110, 112 and bottom liner 114 are affixed together at their periphery. A thumb protector 120 is sandwiched between the top and bottom layers 110, 112 of the thumb member 14.

The thumb protector 120 will now be described in more detail with respect to FIGS. 7 to 25. The thumb protector 120 has a top section 122, five middle sections 124, and a bottom section 126. The middle sections 124 are disposed between the top section 122 and the bottom section 126. Each of the sections 122, 124, 126 is fabricated from a rigid material, such as rigid plastic for example. In one embodiment, the sections 122, 124, 126 are made via injection molding using high-density polyethylene (HDPE). In an alternative embodiment, the thumb protector 120 may include more or fewer than five middle sections 124, depending on the desired length of the protector 120 or the anatomical requirements of the user. The number of middle sections 124 can be varied to accommodate different hand sizes or specific application needs.

The top section 122, five middle sections 124, and the bottom section 126 are connected to each other via a central wire 128, a left wire 130, and a right wire 132, as will be described in more detail below. The wires 128, 130, 132 are made from material that is strong enough to prevent hyperflexion of the thumb T, flexible enough to allow multidirectional thumb flexion, and resistant to rust or damage from sweat and humidity commonly found in hockey equipment environments. It is contemplated that each wire 128, 130, 132 could replaced by a corresponding cable made from multiple wires. For example, the wires 128, 130, 132 could be made from stainless steel, nylon (polyamide) or polyester.

The thumb protector 120 also has a central crimp 134, a left crimp 136, and a right crimp 138. The central crimp 134 is connected to the end of the central wire 128 extending from the bottom section 126. The left crimp 136 is connected to the end of the left wire 130 extending from the bottom section 126. The right crimp 138 is connected to the end of the right wire 132 extending from the bottom section 126.

The top section 122 has a curved top edge and an arcuate lateral cross-section. The wires 128, 130, 132 are connected to the top section 122. The top section 122 defines a central top passage 140 inside which the central wire 128 extends. In the present embodiment, the central wire 128 is fixed to the top section 122 by injecting the plastic forming the top section 122 over the central wire 128. The top section 122 defines a top left passage 142 and a top right passage 144 inside which the left wire 130 and the right wire 132 extend respectively. In the present embodiment, the top left passage 142 and the top right passage 144 communicate with each other to form a U-shaped passage 146 extending near an outer edge of the top section 122. In the present embodiment, the left wire 130 and the right wire 132 are an integral wire that extends though the U-shaped passage. In the present embodiment, the integral wire forming the left wire 130 and the right wire 132 is fixed to the top section 122 by injecting the plastic forming the top section 122 over this wire. It is contemplated that the top left passage 142 and the top right passage 144 could not communicate with each other and that the left wire 130 and the right wire 132 could be separate wires extending inside their respective passages 142, 144. It is contemplated that the wires 128, 130, 132, could be connected to the top section 122 differently, such as by adhesive, crimps or other mechanical fasteners.

The bottom edge of the top section 122 defines a laterally centered top groove 148 defining part of a top articulation 150 between the top section 122 and the middle section 124 that is adjacent to the top section 122 as will be described in more detail below. In the present embodiment, the top groove 148 is semi-circular, but other shapes are contemplated. The central top passage 140 extends from an apex of the top groove 148.

With reference to FIGS. 14 to 17, one of the five middle sections 124 will be described in more detail. As in the present embodiment, all middle sections 124 are identical, this description applies to all middle sections 124. It is contemplated that in some embodiment one or more of the five middle sections 124 could differ from the one or more of the other middle sections 124.

Figure 16:
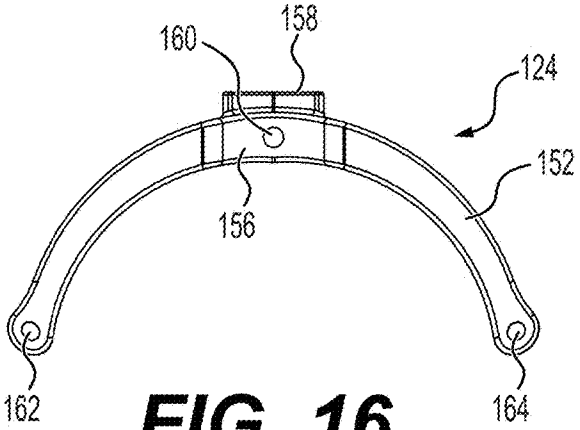
FIG. 16 is a bottom view of the middle section of FIG. 14.

The middle section 124 has a body 152 having an arcuate lateral profile as best seen in FIG. 16. The body 152 of the middle section 124 tapers as it extends from its center to its lateral ends. A top edge of the body 152 of the middle section 124 defines a laterally centered middle tongue 154. In the present embodiment, the middle tongue 154 is semi-circular in shape, but other shapes are contemplated. A bottom edge of the body 152 of the middle section 124 defines a laterally centered middle groove 156. In the present embodiment, the middle groove 156 is semi-circular in shape, but other shapes are contemplated. A laterally centered middle protrusion 158 is disposed on top of the body 152 and extends past the middle tongue 154. In the present embodiment, the middle protrusion 158 has an arcuate convex top edge and an arcuate concave bottom edge. It is contemplated that in an alternative embodiment the middle protrusion 158 could have an arcuate concave top edge and an arcuate convex bottom edge. It is also contemplated that the top and bottom edges of the middle protrusion 158 could have a different shape.

The body 152 of the middle section 124 defines a central middle passage 160, a left middle passage 162, and a right middle passage 164. The central middle passage 160 extends from an apex of the middle groove 156 to an apex of the middle tongue 154. The left middle passage 162 and the right middle passage 164 extend longitudinally trough the body 152 near the left and right edges of the middle section 124. The central wire 128 extends through the central middle passage 160 of each middle section 124 to connect the middle sections 124 to the top section 122. The left wire 130 extends through the left middle passage 162 of each middle section 124. The right wire 132 extends through the right middle passage 164 of each middle section 124. Diameters of the left wire 130 and the left middle passage 162 are selected such that the left wire 130 can slide inside the left middle passage 162. Diameters of the right wire 132 and the right middle passage 164 are selected such that the right wire 132 can slide inside the right middle passage 164.

Figure 8:
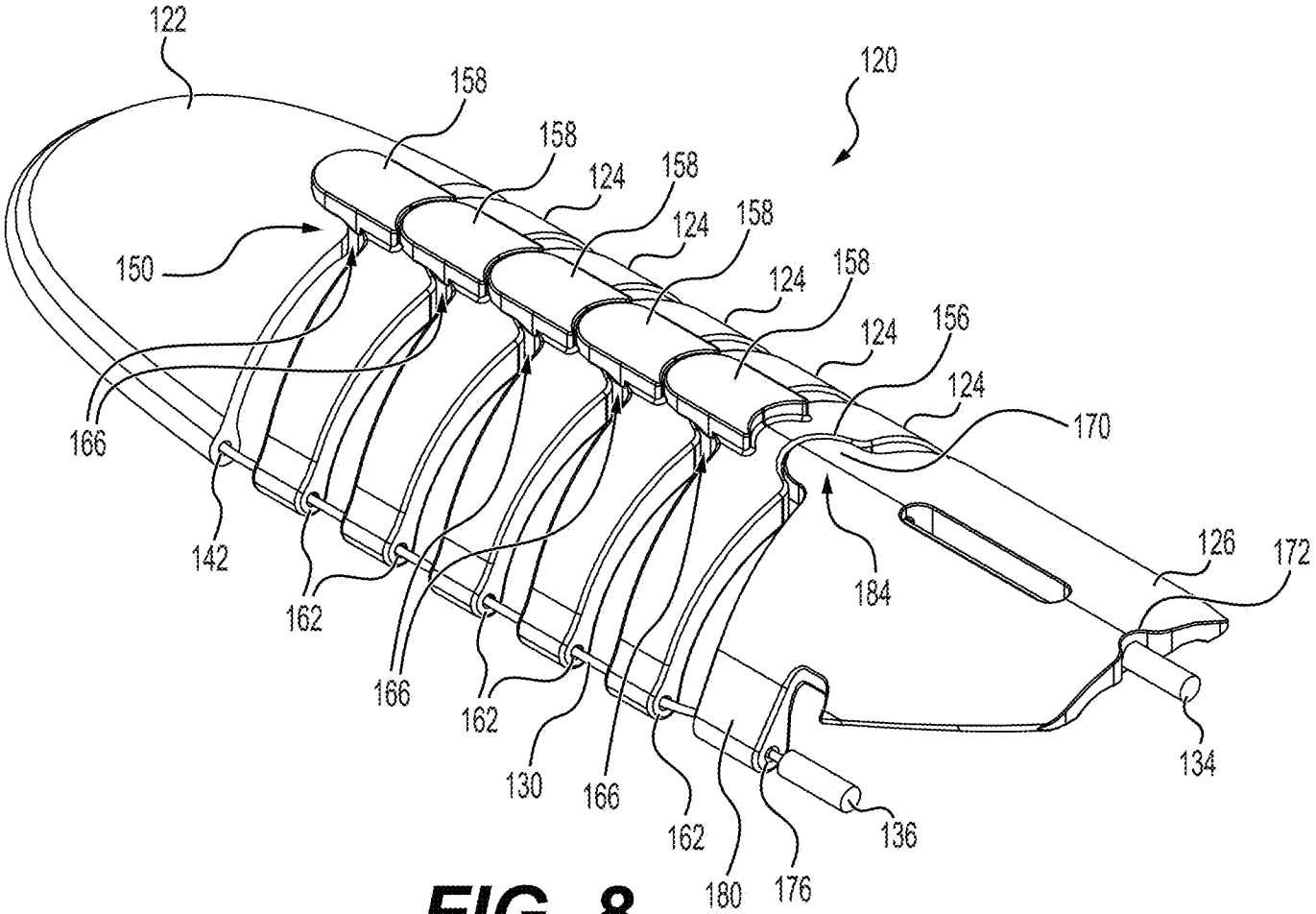
FIG. 8 is a perspective view of the thumb protector of FIG. 3 in a neutral position.
Figure 10:
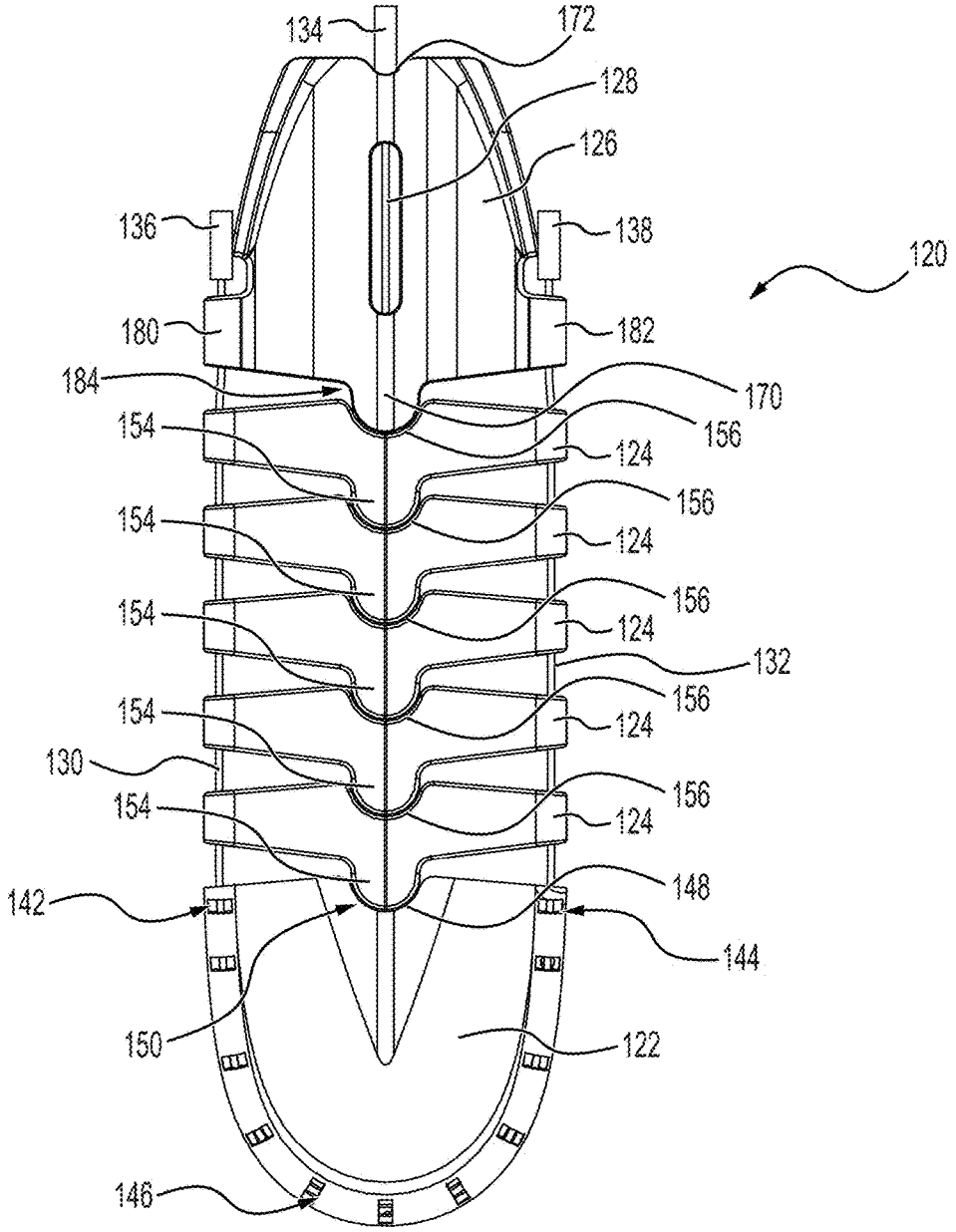
FIG. 10 is a front view of the thumb protector of FIG. 8.
Figure 11:
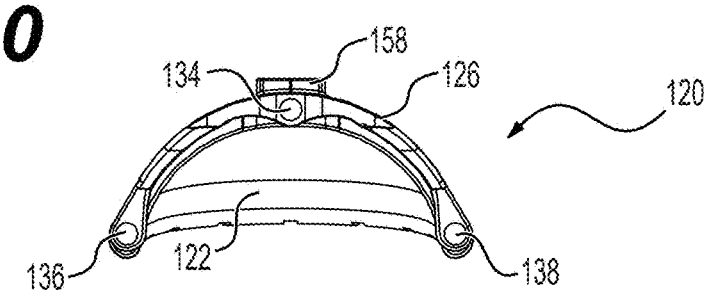
FIG. 11 a bottom view of the thumb protector of FIG. 8.
Figure 12:
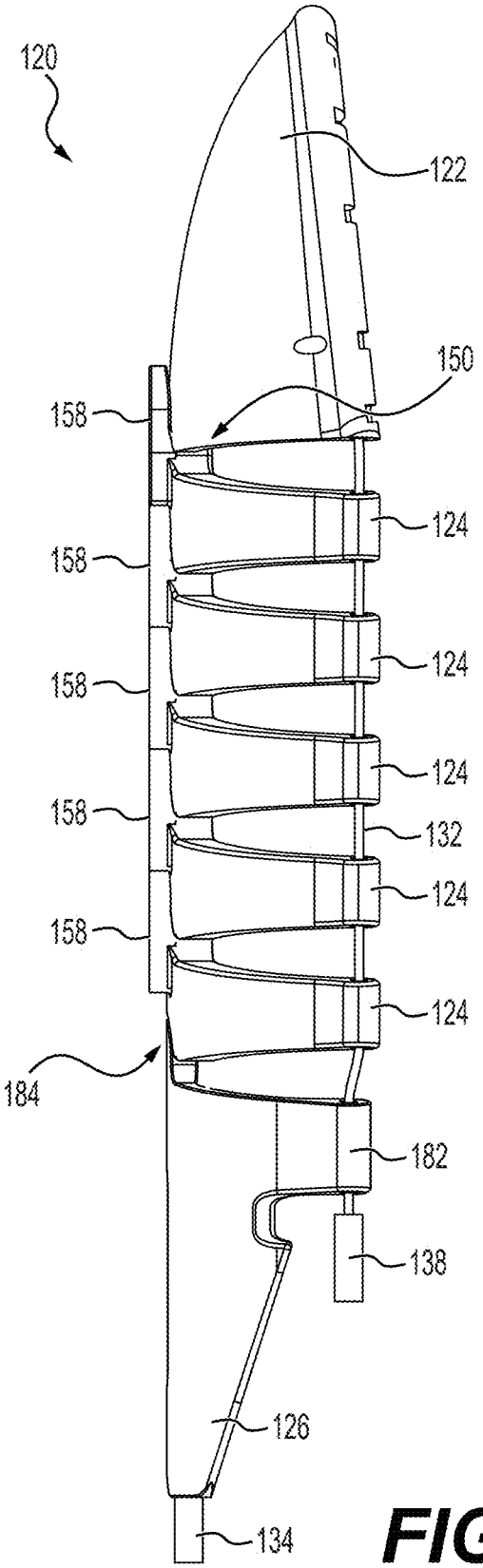
FIG. 12 is a side view of the thumb protector of FIG. 8.
Figure 13:
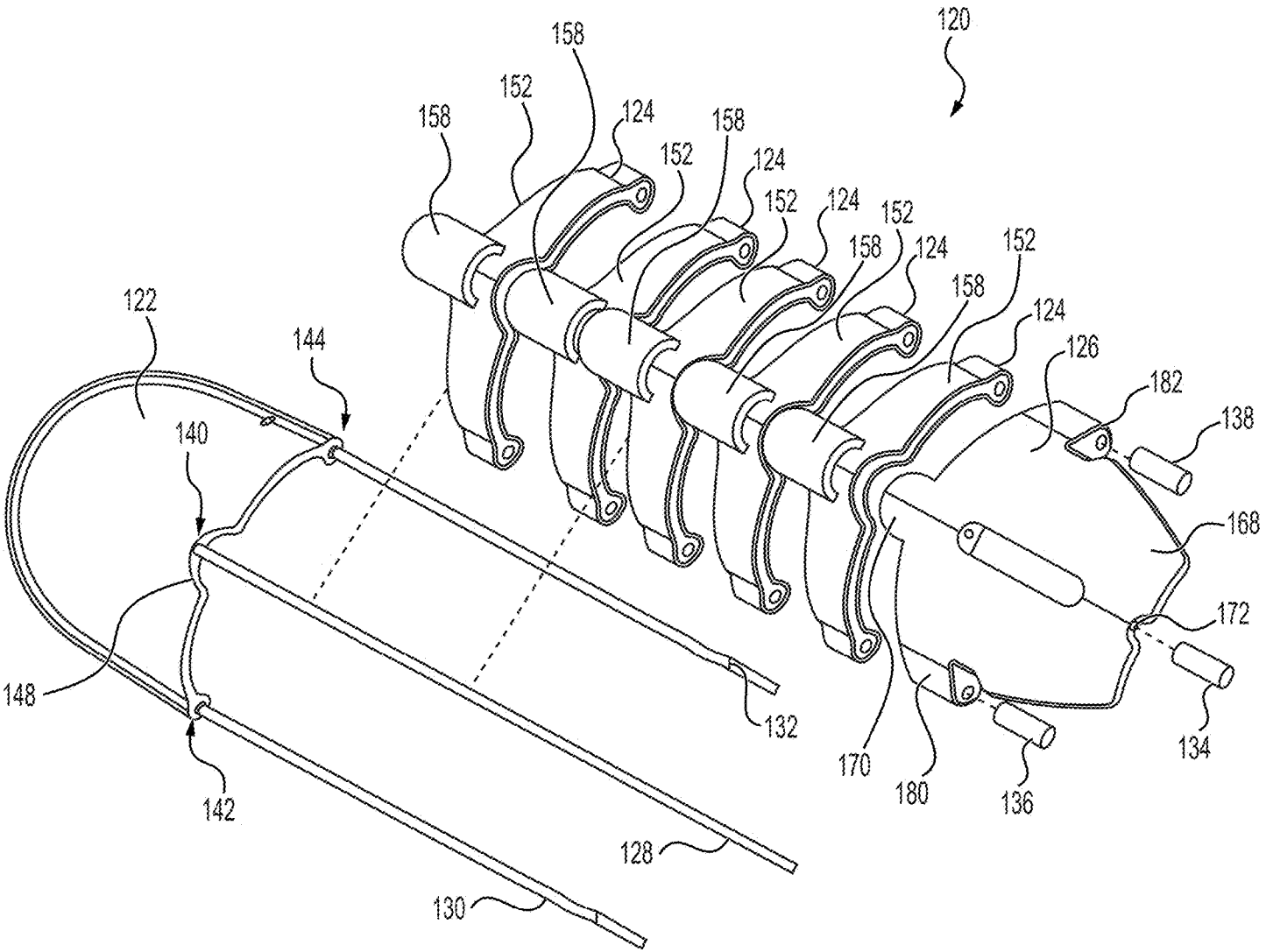
FIG. 13 is an exploded perspective view of the thumb protector of FIG. 8.
Figure 15:
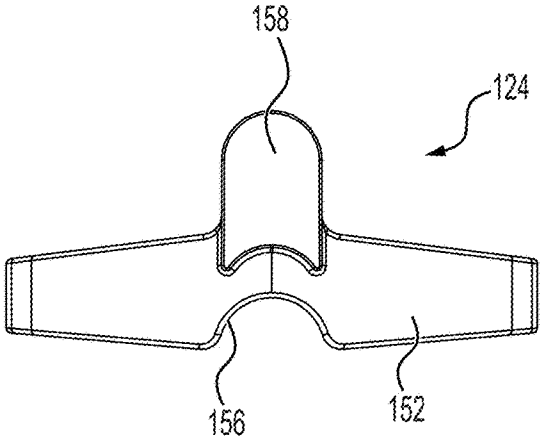
FIG. 15 is a back view of the middle section of FIG. 14.
Figure 17:
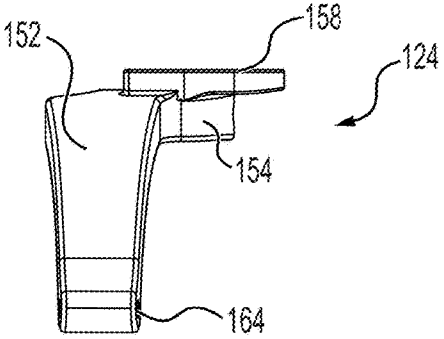
FIG. 17 is a side view of the middle section of FIG. 14.
Figure 14:
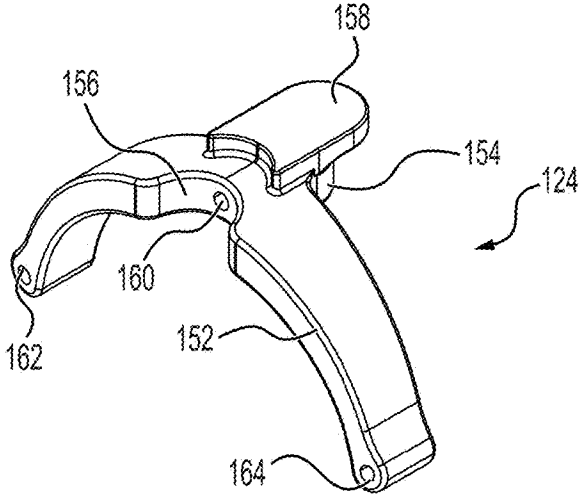
FIG. 14 is a perspective view of a middle section of the thumb protector of FIG. 8.

As best seen in FIG. 10, the top section 122 engages the adjacent middle section 124 via the top articulation 150. The top articulation 150 is defined by the top groove 148 and the middle tongue 154 of the adjacent middle section 124 being received in the top groove 148. It is contemplated that in an alternative embodiment, the top articulation 150 could be defined by a tongue defined by a bottom edge of top section 122 received in a groove defined by a top edge of the adjacent middle section 124. The central wire 128 extends through the top articulation 150. The middle protrusion 158 of the middle section 124 adjacent to the top section 122 overlaps the top section 122, as best seen in FIGS. 8 and 12.

As also best seen in FIG. 10, adjacent middle sections 124 engage each other via a middle articulation 166. Each middle articulation 166 is defined by the middle groove 156 of one middle section 124 and the middle tongue 154 of the adjacent middle section 124 being received in the middle groove 156. It is contemplated that in an alternative embodiment, the middle groove 156 could be defined by the top edge of middle section 124 and the middle tongue 154 could be defined by the bottom edge of the middle section 124. The central wire 128 extends through each middle articulation 166. The middle protrusion 158 of each of the lower four middle sections 124 overlaps the corresponding adjacent middle section 124, as best seen in FIGS. 8 and 12.

Figure 19:
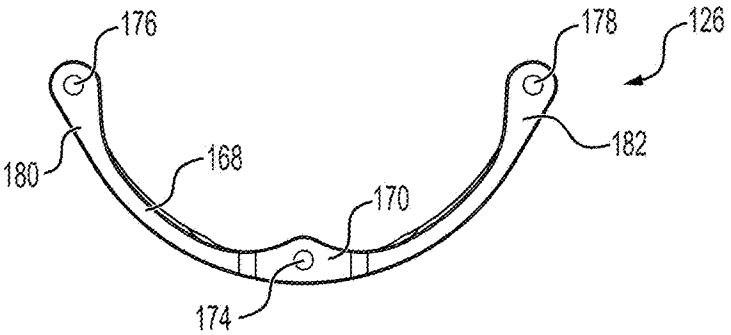
FIG. 19 is a top view of the bottom section of FIG. 18.
Figure 21:
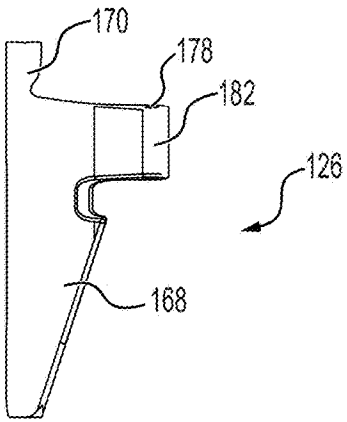
FIG. 21 is a side view of the bottom section of FIG. 18.
Figure 18:
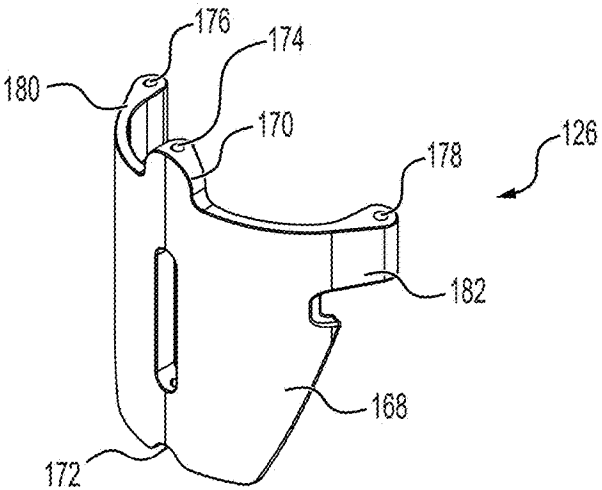
FIG. 18 is a perspective view of a bottom section of the thumb protector of FIG. 8.
Figure 20:
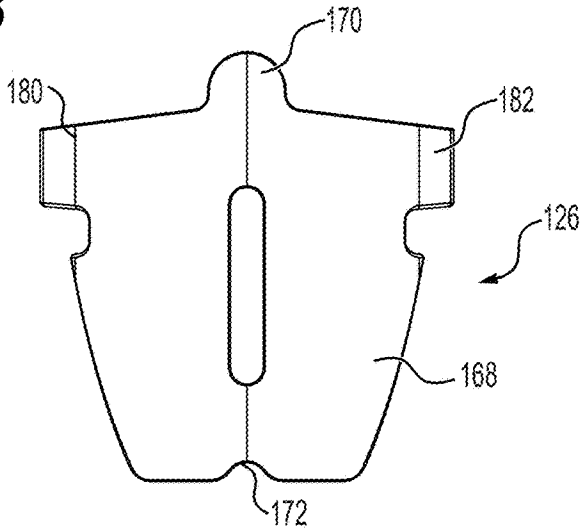
FIG. 20 is a back view of the bottom section of FIG. 18.

With reference to FIGS. 18 to 21, the bottom section 126 will be described in more detail. The bottom section 126 has a body 168 having an arcuate lateral profile as best seen in FIG. 19. A top edge of the body 168 of the bottom section 126 defines a laterally centered bottom tongue 170. In the present embodiment, the bottom tongue 170 is semi-circular in shape, but other shapes are contemplated. A bottom edge of the body 168 of the bottom section 126 defines a laterally centered bottom groove 172. In the present embodiment, the bottom groove 172 is semi-circular in shape, but other shapes are contemplated. It is also contemplated that the bottom groove 172 could be omitted. It is contemplated that in an alternative embodiment the bottom section 126 could have a bottom protrusion similar to the middle protrusion 158 to overlap the adjacent middle section 124.

The body 168 of the bottom section 126 defines a central bottom passage 174, a left bottom passage 176, and a right bottom passage 178. The central bottom passage 174 extends from an apex of the bottom groove 172 to an apex of the bottom tongue 170. The body 168 of the bottom section 126 has a left wing 180 and a right wing 182. The left bottom passage 176 and the right bottom passage 178 extend longitudinally trough the laterally outer edges of the left wing 180 and of the right wing 182 respectively. The central wire 128 extends through the central bottom passage 174 of each bottom section 126 to connect the bottom section 126 to the middle sections 124 and the top section 122. The central crimp 134 prevents the bottom section 126 and the middle sections 124 from sliding off the central wire 128. The left wire 130 extends through the left bottom passage 176. The right wire 132 extends through the right bottom passage 178. Diameters of the left wire 130 and the left bottom passage 176 are selected such that the left wire 130 can slide inside the left bottom passage 176. Diameters of the right wire 132 and the right bottom passage 178 are selected such that the right wire 132 can slide inside the right bottom passage 178.

Figure 9:
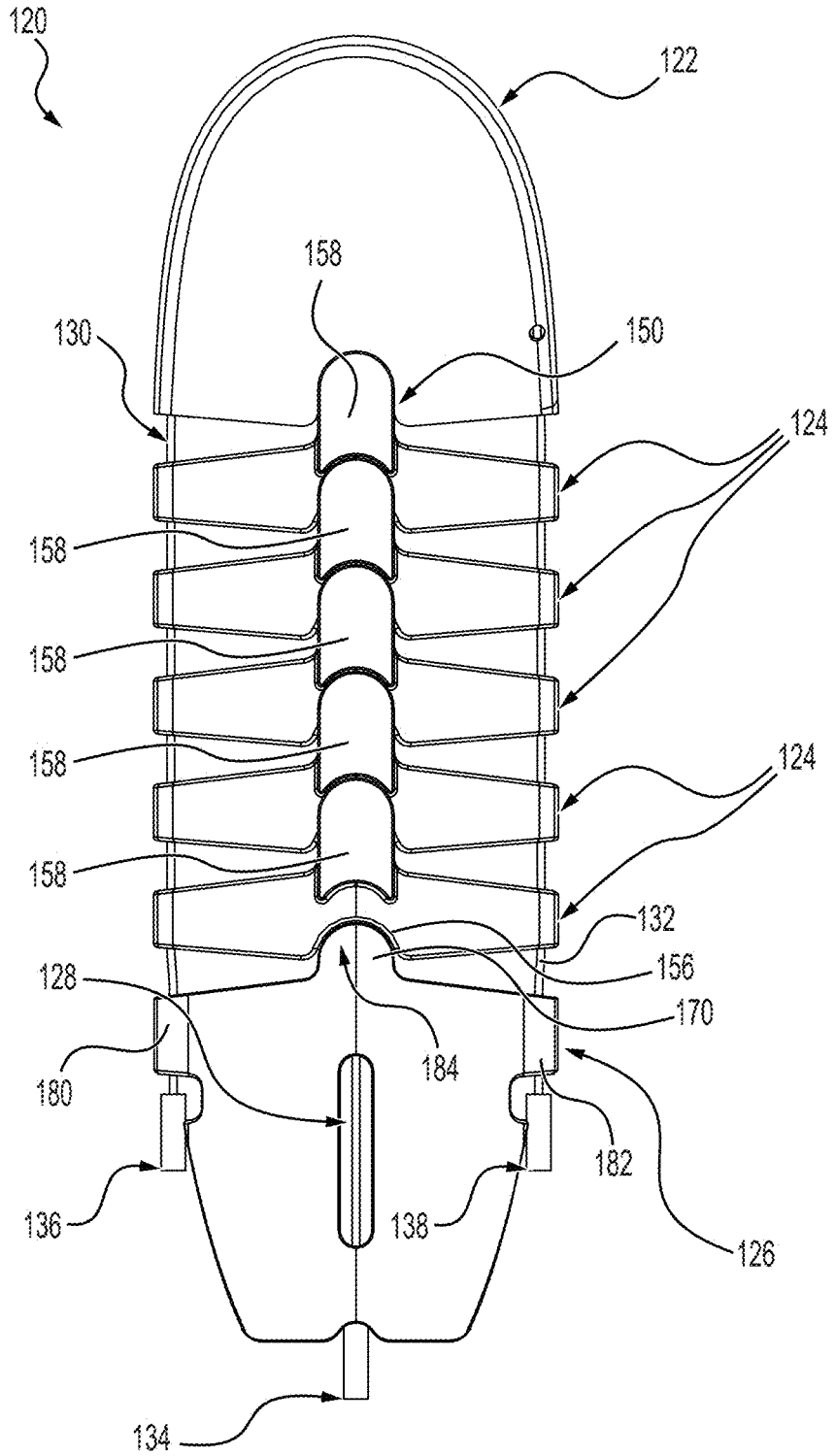
FIG. 9 is a back view of the thumb protector of FIG. 8.

As best seen in FIGS. 8 to 10, the bottom section 126 engages the adjacent middle section 124 via the bottom articulation 184. The bottom articulation 184 is defined by the middle groove 156 of the adjacent middle section 124 and the bottom tongue 170 being received in that middle groove 156. It is contemplated that in an alternative embodiment, the bottom articulation 184 could be defined by a tongue defined by a bottom edge of adjacent middle section 124 received in a groove defined by a top edge of the bottom section 126. The central wire 128 extends through the bottom articulation 184.

As will be described below, the left wire 130 and the right wire 132 function as sliding guides that, by enabling relative movement between the top section 122, the middle section 124, and the bottom section 126, afford multidirectional motion of the thumb T while protecting the thumb T during use in the hockey glove 10.

The thumb protector 120 has a neutral position shown in FIGS. 8 to 12. As can be seen, in the neutral position left spaces are defined between left sides of adjacent ones of the top section 122, the middle sections 124, and the bottom section 126, and right spaces are defined between right sides of the adjacent ones of the top section 122, the middle sections 124, and the bottom section 126. As can also be seen, in the neutral position the left wire 130 extends from the bottom section 126 such that there is a space between the left wing 180 and the left crimp 136, and the right wire 132 extends from the bottom section 126 such that there is a space between the right wing 182 and the right crimp 138.

Figure 22:
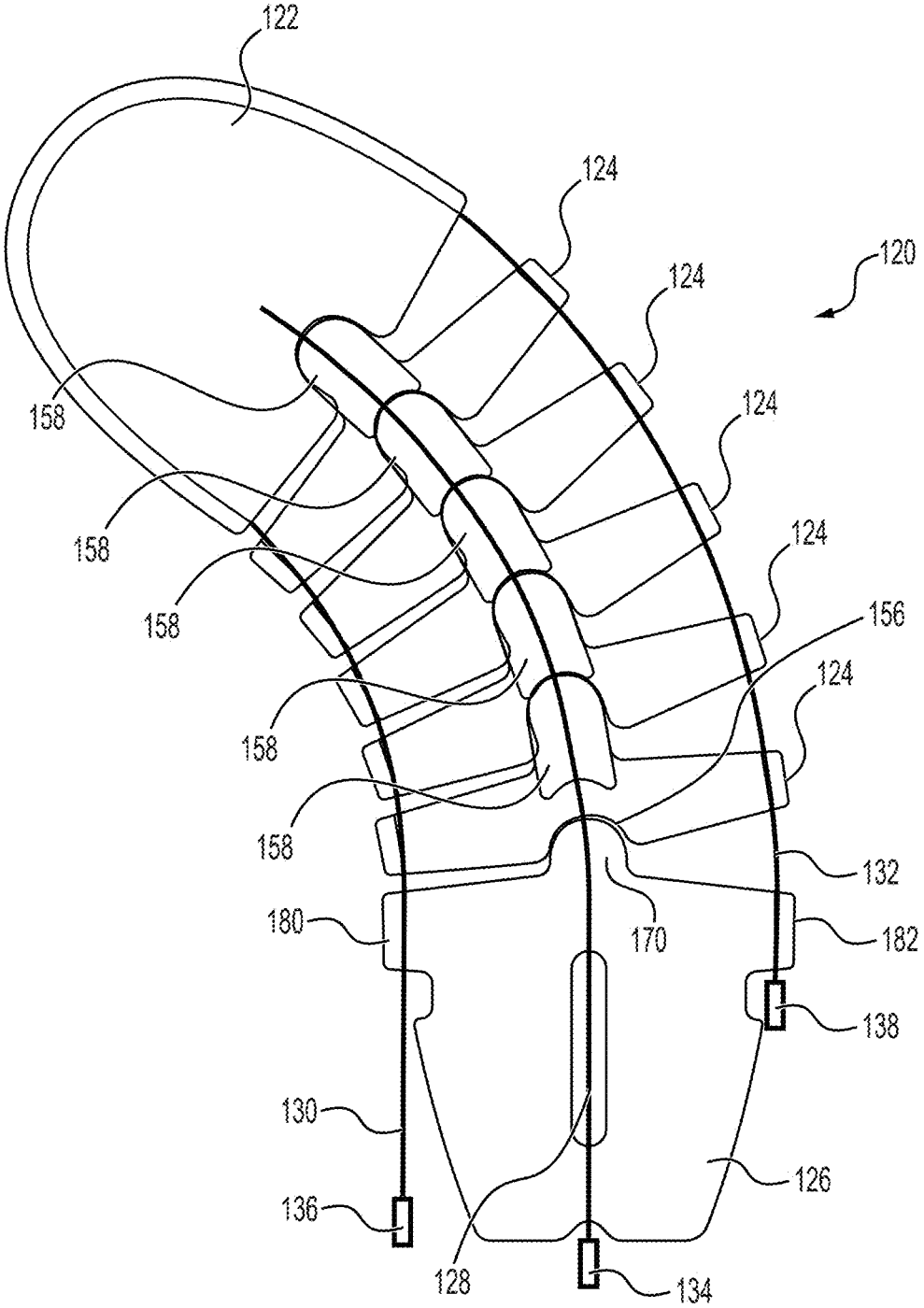
FIG. 22 is a back view of the thumb protector of FIG. 8 in a left flexed position.

The thumb protector 120 also has a number of left flexed positions permitted by the top articulation 150, the middle articulations 166, and the bottom articulation 184, one of which is shown in FIG. 22. As can be seen by comparing FIGS. 22 and 9, in the left flexed position the left spaces defined between the left sides of the adjacent ones of the top section 122, the middle section 124, and the bottom section 126 are smaller than in the neutral position, and the right spaces defined between right sides of the adjacent ones of the top section 122, the middle sections 124, and the bottom section 126 are larger than in the neutral position. As can also be seen by comparing FIGS. 22 and 9, in the left flexed position the left wire 130 extends from the left wing 180 of the bottom section 126 by a distance that is longer than in the neutral position, and the right wire 132 extends from the right wing 182 of the bottom section 126 by a distance that is shorter than in the neutral position. The thumb protector 120 can flex toward the left up to a left flexed position where the right crimp 138 abuts a free end of the bottom section 126, in this case a lower edge of the right wing 182. Alternatively or additionally, the thumb protector 120 can flex toward the left up to a left flexed position where the left sides of the adjacent ones of the top section 122, the middle section 124, and the bottom section 126 abut each other.

Figure 23:
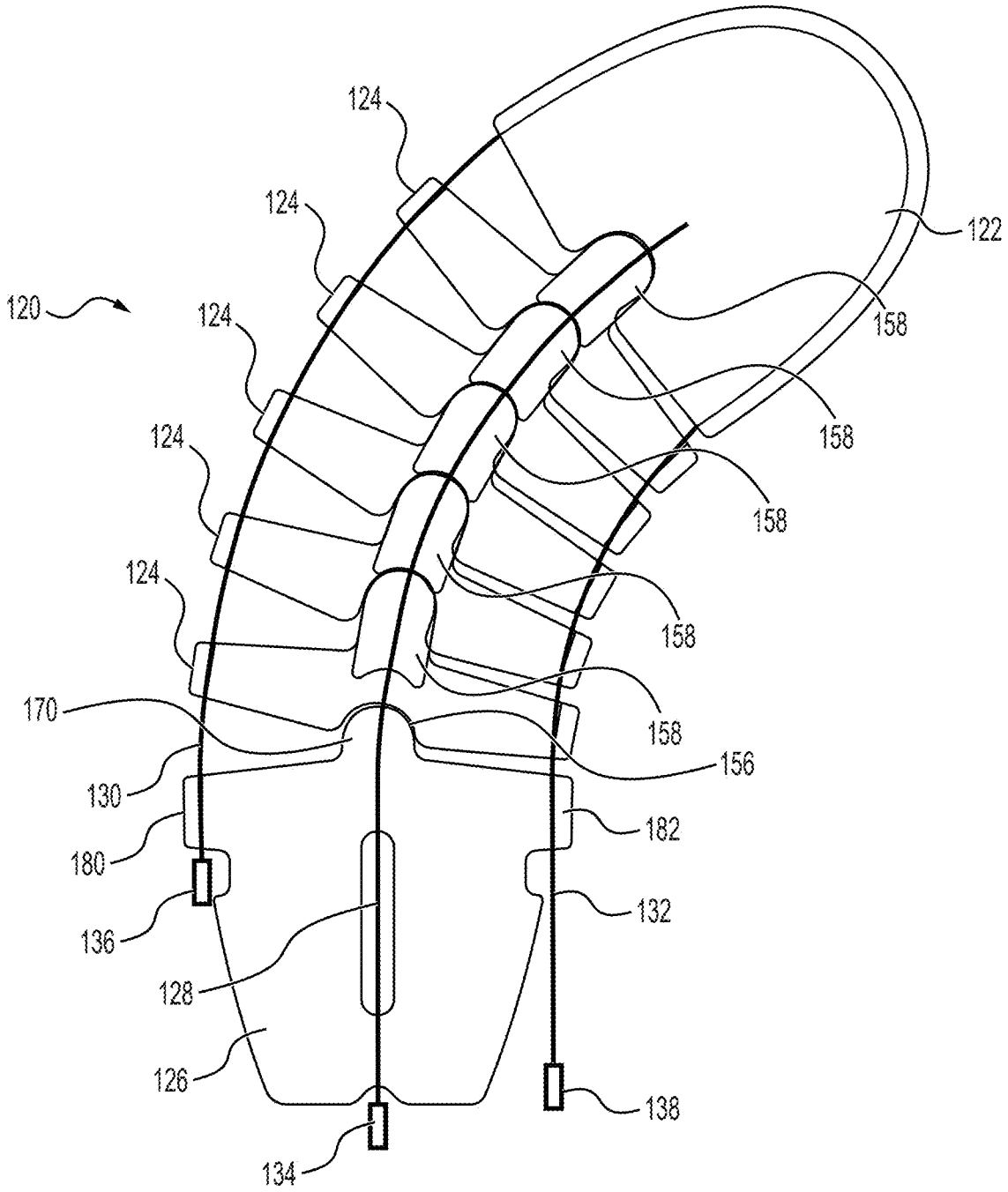
FIG. 23 is a back view of the thumb protector of FIG. 8 in a right flexed position.

The thumb protector 120 also has a number of right flexed positions permitted by the top articulation 150, the middle articulations 166, and the bottom articulation 184, one of which is shown in FIG. 23. As can be seen by comparing FIGS. 23 and 9, in the right flexed position the left spaces defined between the left sides of the adjacent ones of the top section 122, the middle sections 124, and the bottom section 126 are larger than in the neutral position, and the right spaces defined between the right sides of the adjacent ones of the top section 122, the middle sections 124, and the bottom section 126 are smaller than in the neutral position. As can also be seen by comparing FIGS. 23 and 9, the left wire 130 extends from the left wing 180 the bottom section 126 by a distance that is shorter than in the neutral position, and the right wire 132extends from the right wing 182 of the bottom section 126 by a distance that is longer than in the neutral position. The thumb protector 120 can flex toward the right up to a right flexed position where the left crimp 136 abuts a free end of the bottom section 126, in this case a lower edge of the left wing 180. Alternatively or additionally, the thumb protector 120 can flex toward the right up to a right flexed position where the right sides of the adjacent ones of the top section 122, the middle section 124, and the bottom section 126 abut each other.

Figure 24:
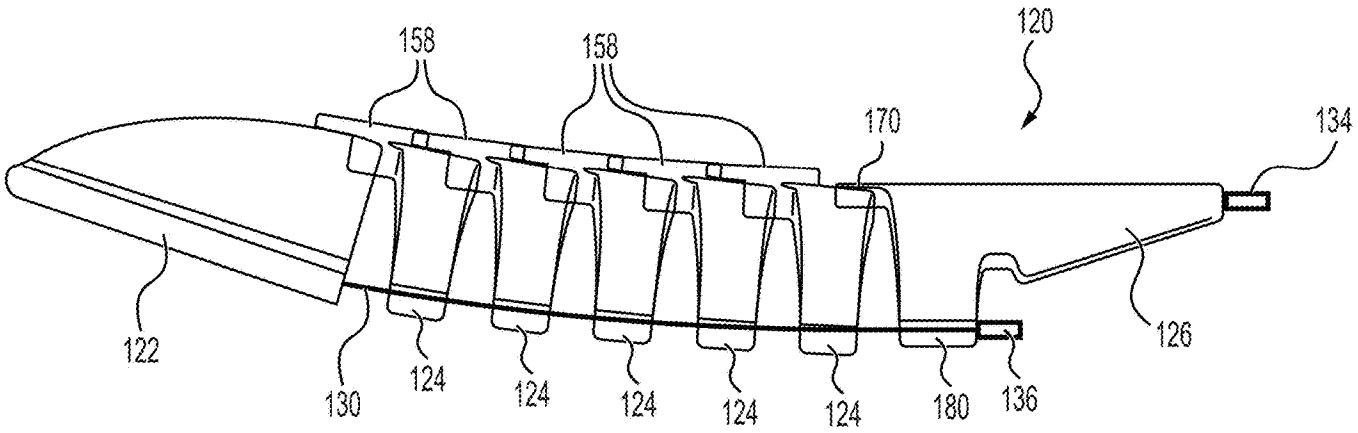
FIG. 24 is a side view of the thumb protector of FIG. 8 in a back extended position.

The thumb protector 120 also has a number of back extended positions, one of which is shown in FIG. 24. As can be seen by comparing FIGS. 24 and 12, in the back extended position both the left and right spaces defined between both the left and right sides of the adjacent ones of the top section 122, the middle section 124, and the bottom section 126 are larger than in the neutral position. As can also be seen by comparing FIGS. 24 and 12, in the back extended position the left wire 130 and the right wires 132 extends from the left wing 180 and the right wing 182 of the bottom section 126 respectively by a distance that is shorter than in the neutral position. The thumb protector 120 can extend back up to a back extended position where the middle protrusions 158 abut the tops of the top section 122 and the middle sections 124 that they overlap, thus preventing hyperextension. Alternatively or additionally, the thumb protector 120 can extend back up to a back extended position where the left crimp 136 abuts the free end of the bottom section 126, in this case the lower edge of the left wing 180, and the right crimp 138 abuts a free end of the bottom section 126, in this case the lower edge of the right wing 182.

Figure 25:
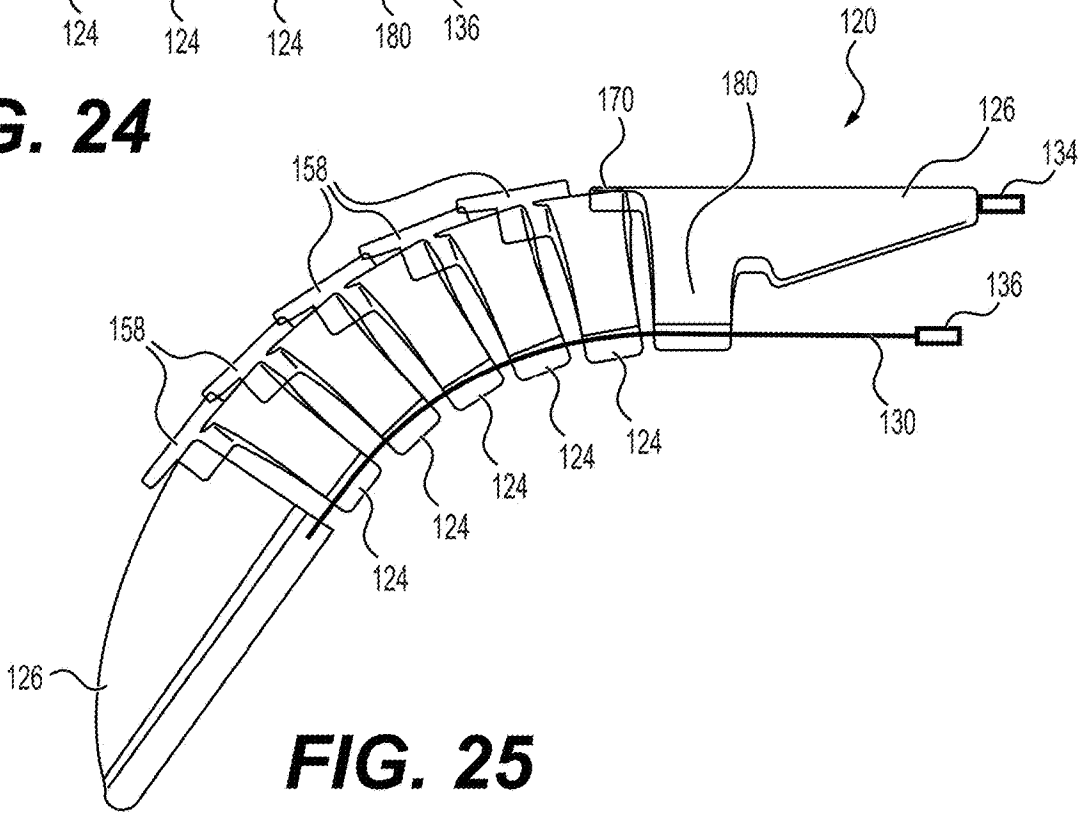
FIG. 25 is a side view of the thumb protector of FIG. 8 in a front flexed position.

The thumb protector 120 also has a number of front flexed positions, one of which is shown in FIG. 25. As can be seen by comparing FIGS. 25 and 12, in the front flexed position both the left and right spaces defined between both the left and right sides of the adjacent ones of the top section 122, the middle section 124, and the bottom section 126 are smaller than in the neutral position. As can also be seen by comparing FIGS. 25 and 12, in the front flexed position the left wire 130 and the right wires 132 extends from the left wing 180 and the right wing 182 of the bottom section 126 respectively by a distance that is longer than in the neutral position. The thumb protector 120 can flex forward up to a front flexed position where the central crimp 134 abuts the lower edge of the bottom section 126, thus preventing hyperflexion. Alternatively or additionally, the thumb protector 120 can flex forward up to a front flexed position where the left sides of the adjacent ones of the top section 122, the middle section 124, and the bottom section 126 abut each other and where the right sides of the adjacent ones of the top section 122, the middle section 124, and the bottom section 126 abut each other.

Although not shown, the thumb protector 120 can simultaneously be flexed laterally (i.e. left or right) and back or forward. The thumb member 14 of the hockey glove 10 is constructed to move with the thumb protector 120.

Figure 26:
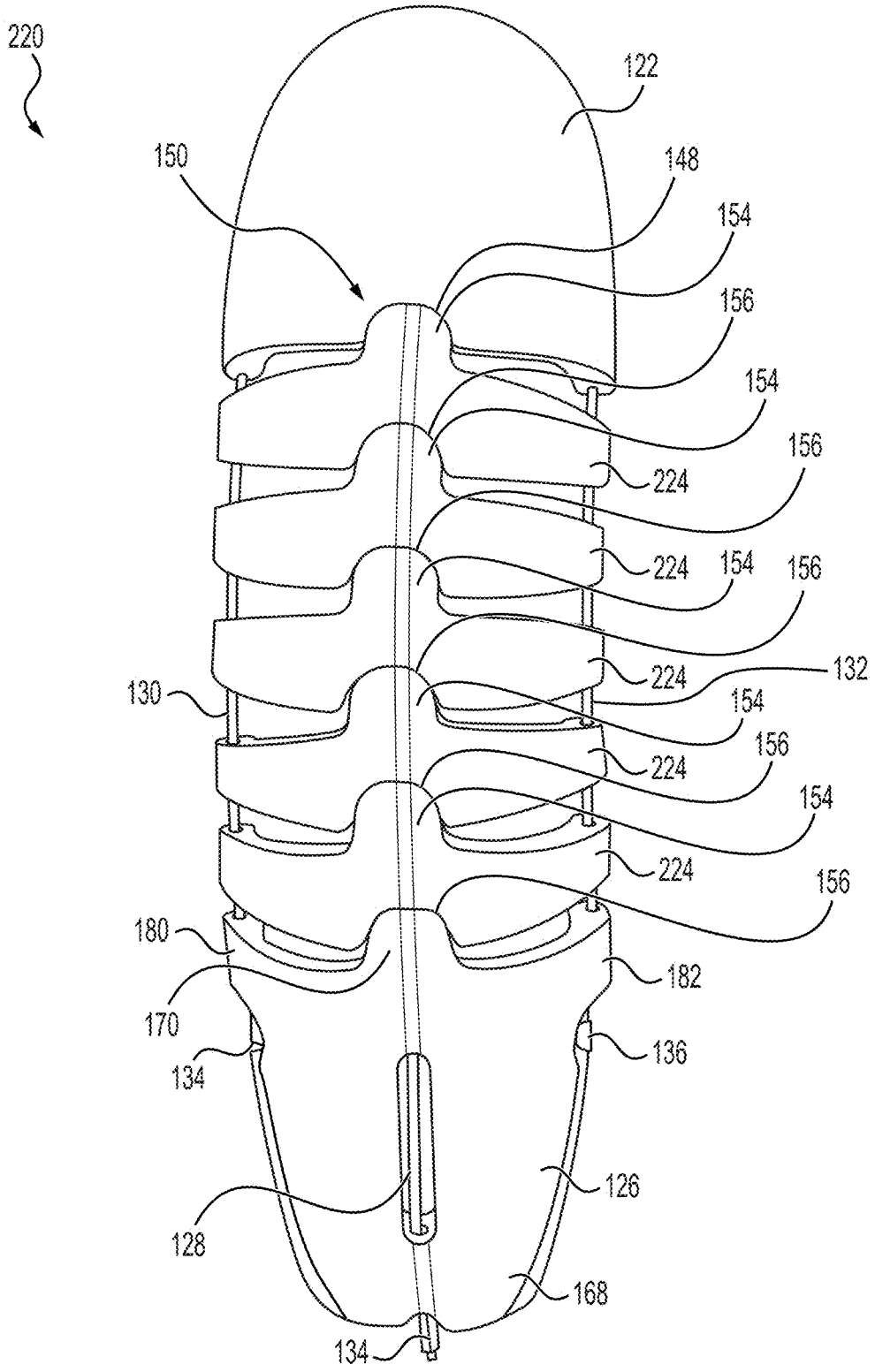
FIG. 26 is a back view of an alternative embodiment of the thumb protector of FIG. 8.

FIG. 26 illustrates a thumb protector 220 that is an alternative embodiment of the thumb protector 120 described above. For simplicity, features of the thumb protector 220 that correspond to those of the thumb protector 120 have been provided with the same reference numerals and will not be described again. In the thumb protector 220, the middle sections 124 have been replaced by middle sections 224. The middle sections 224 have the same structure as the middle sections 124 except that the middle protrusions 158 have been omitted. As such, the thumb protector 220 can extend back up to a back extended position where the left crimp 136 abuts the free end of the bottom section 126, in this case the lower edge of the left wing 180, and the right crimp 138 abuts a free end of the bottom section 126, in this case the lower edge of the right wing 182.

Figure 6:
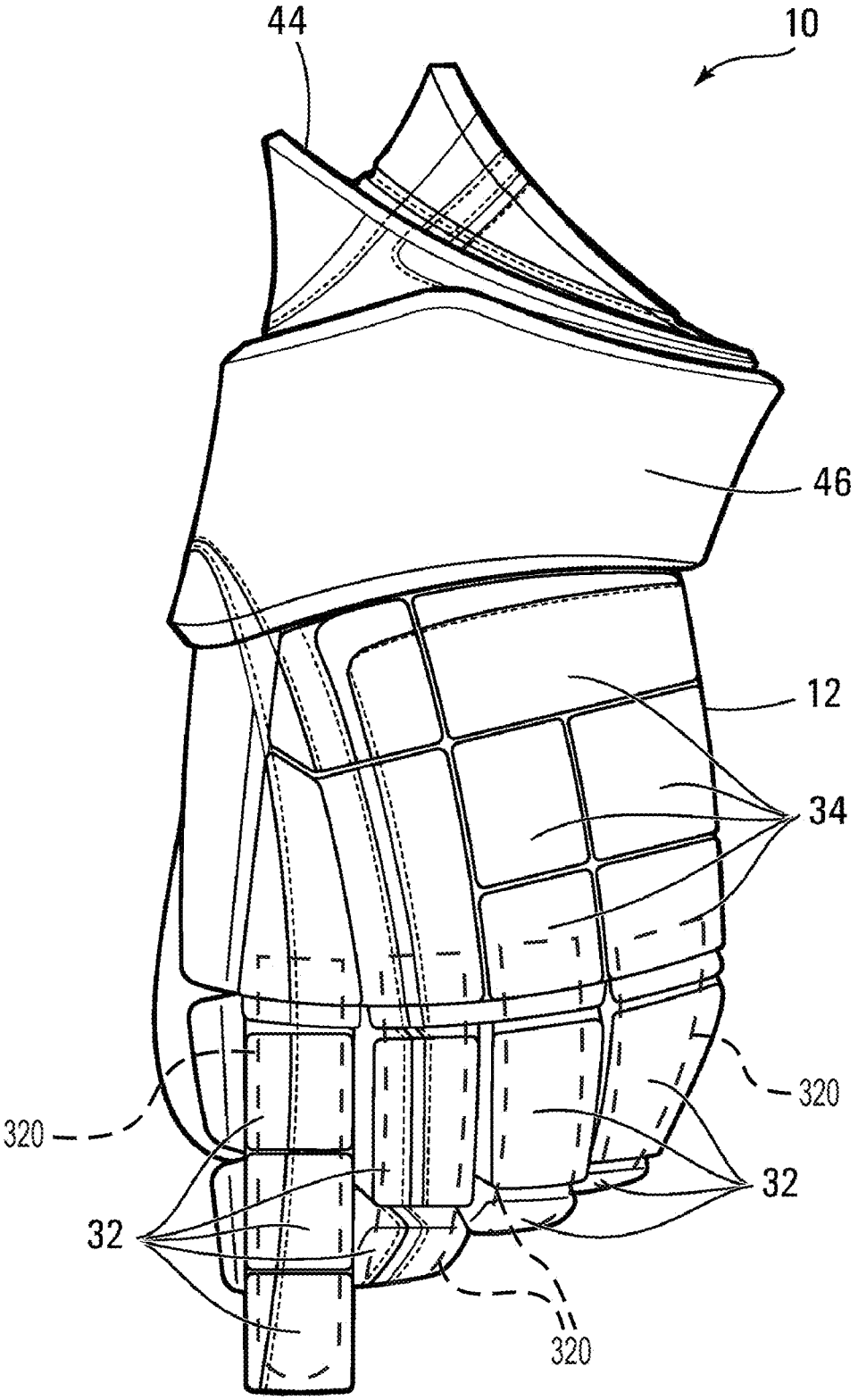
FIG. 6 is a back view of the hockey glove of FIG. 2.

It is contemplated that the finger sheaths 16, 18, 20, 22 could each receive a finger protector 320 having a construction similar to the thumb protector 120 or 220 as schematically shown in FIG. 6. For each finger protector 320, the dimensions and specific shapes of the top section 122, the middle section 124/224, and the bottom section 126, the number of middle sections 124/224, and the lengths of the wires 128, 130, 132 could be different from those of the thumb protector 120 or 220 to accommodate the anatomical properties of the finger to be protected. It is contemplated that only one, two or three of the finger sheaths 16, 18, 20, 22 could receive a finger protector 320.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A thumb or finger protector for providing multidirectional thumb or finger movement in a protective glove, comprising:

a top section;

at least one middle section defining a left middle passage, a right middle passage, and a central middle passage;

a bottom section defining a left bottom passage, a right bottom passage, and a central bottom passage, the at least one middle section being disposed between the top section and the bottom section, the top section engaging an adjacent one of the at least one middle section via a top articulation, the bottom section engaging an adjacent one of the at least one middle section via a bottom articulation;

a central wire connected to the top section and extending through the central middle passage of the at least one middle section and through the central bottom passage of the bottom section for connecting the top section, the at least one middle section and the bottom section to each other, the central wire extending through the top articulation and the bottom articulation;

a left wire connected to the top section and extending through the left middle passage of the at least one middle section and through the left bottom passage of the bottom section, the left wire being sized for sliding inside the left middle passage of the at least one middle section and through the left bottom passage of the bottom section; and a right wire connected to the top section and extending through the right middle passage of the at least one middle section and through the right bottom passage of the bottom section, the right wire being sized for sliding inside the right middle passage of the at least one middle section and through the right bottom passage of the bottom section, the left wire and the right wire functioning as sliding guides that, by enabling relative movement between the top section, the at least one middle section, and the bottom section, afford multidirectional motion of the thumb or finger while protecting the thumb or finger during use in the protective glove.

2. The thumb or finger protector of claim 1, wherein:

the top section defines a left top passage, a right top passage, and a central top passage;

the central wire extending in the central top passage;

the left wire extending in the left top passage; and the right wire extending in the right top passage.

3. The thumb or finger protector of claim 1, wherein:

the top left passage and the top right passage communicate with each other to form a U-shaped passage; and the left wire and the right wire are an integral wire extending through the U-shaped passage.

4. The thumb or finger protector of claim 1, wherein the left wire, the right wire and the central wire are fixed to the top section.

5. The thumb or finger protector of claim 1, wherein:

the top articulation is defined by a top groove and a middle tongue received in the top groove;

the top groove is defined by the top section;

the middle tongue is defined by the one of the at least one middle section that is adjacent to the top section;

the bottom articulation is defined by a bottom tongue and a middle groove receiving the bottom tongue;

the bottom tongue is defined by the bottom section; and the middle groove is defined by the one of the at least one middle section that is adjacent to the bottom section.

6. The thumb or finger protector of claim 1, wherein:

the at least one middle section is a plurality of middle sections; and adjacent middle sections of the plurality of middle sections engage each other via a middle articulation.

7. The thumb or finger protector of claim 6, wherein the middle articulation of the adjacent middle sections of the plurality of middle section is defined by a groove defined in one of the adjacent middle sections and by a tongue defined in another one of the adjacent middle sections.

8. The thumb or finger protector of claim 1, wherein:

the thumb or finger protector has a neutral position, a left flexed position, and a right flexed position;

in the neutral position:

left spaces are defined between left sides of adjacent ones of the top section, the at least one middle section, and the bottom section, and right spaces are defined between right sides of the adjacent ones of the top section, the at least one middle section, and the bottom section;

in the left flexed position:

the left spaces defined between the left sides of the adjacent ones of the top section, the at least one middle section, and the bottom section are smaller than in the neutral position, and the right spaces defined between right sides of the adjacent ones of the top section, the at least one middle section, and the bottom section are larger than in the neutral position; and in the right flexed position:

the left spaces defined between the left sides of the adjacent ones of the top section, the at least one middle section, and the bottom section are larger than in the neutral position, and the right spaces defined between the right sides of the adjacent ones of the top section, the at least one middle section, and the bottom section are smaller than in the neutral position.

9. The thumb or finger protector of claim 8, wherein:

in the neutral position:

the left wire extends from the bottom section, and the right wire extends from the bottom section;

in the left flexed position:

the left wire extends from the bottom section by a distance that is longer than in the neutral position; and the right wire extends from the bottom section by a distance that is shorter than in the neutral position; and in the right flexed position:

the left wire extends from the bottom section by a distance that is shorter than in the neutral position; and the right wire extends from the bottom section by a distance that is longer than in the neutral position.

10. The thumb or finger protector of claim 1, further comprising:

a central crimp connected to an end of a portion of the central wire extending from the bottom section;

a left crimp connected to an end of a portion of the left wire extending from the bottom section; and a right crimp connected to an end of a portion of the right wire extending from the bottom section.

11. The thumb or finger protector of claim 10, wherein the left crimp and the right crimp selectively abut a free end of the bottom section.

12. The thumb or finger protector of claim 1, wherein:

each of the at least one middle section has a middle protrusion overlapping an adjacent one of:

the top section, or another one of the at least one middle section, the middle protrusion limiting hyperextension.

13. The thumb or finger protector of claim 1, wherein the top section, the at least one middle section, and the bottom section are fabricated from a rigid plastic.

14. A protective glove comprising:

a hand receiving portion having four finger sheaths;

a thumb member connected to the hand receiving portion; and at least one of the thumb or finger protector of claim 1 received in at least one of the four finger sheaths or the thumb member for protecting a dorsal side of a corresponding thumb or finger of a hand inserted in the protective glove.

15. The protective glove of claim 14, wherein the at least one of the thumb and finger protector is a thumb protector received in the thumb member.

16. The protective glove of claim 14, wherein the at least one of the thumb and finger protector is at least one finger protector received in at least one of the four finger sheaths.

17. The protective glove of claim 14, wherein each of the four finger sheaths and the thumb member has elongated protective pads extending along a dorsal side of each of the four finger sheaths and the thumb member.

18. The protective glove of claim 14, wherein the protective glove is a sport glove.

19. The protective glove of claim 18, wherein the sport glove is a hockey glove.

* * * * *